US005651426A

United States Patent [19]

Bittar et al.

[11] Patent Number: 5,651,426

[45] Date of Patent: Jul. 29, 1997

[54] SYNCHRONOUS ELEVATOR SHUTTLE SYSTEM

[75] Inventors: Joseph Bittar, Avon; Anthony Cooney, Unionville; Richard C. McCarthy, Simsbury; Frederick H. Barker, Bristol; Bruce A. Powell, Canton; Samuel C. Wan, Simsbury; Paul Bennett, Waterbury; LucyMary Salmon, South Windsor, all of Conn.

[73] Assignee: Otis Elevator Company, Farmington, Conn.

[21] Appl. No.: 564,534

[22] Filed: Nov. 29, 1995

[51] Int. Cl.[6] ..... B66B 9/00

[52] U.S. Cl. ..... 187/249; 187/382

[58] Field of Search ..... 187/249, 239, 187/257, 256, 380, 382

[56] References Cited

U.S. PATENT DOCUMENTS

| | | | |
|---|---|---|---|
| 1,580,310 | 4/1926 | Lepley . | |
| 1,939,729 | 12/1933 | Stark | 187/1 |
| 2,052,690 | 9/1936 | Austin | 187/16 |
| 2,626,721 | 1/1953 | Lodge et al. | 214/52 |
| 5,090,515 | 2/1992 | Takahashi et al. | 187/16 |

FOREIGN PATENT DOCUMENTS 4-361968 12/1992 Japan .

OTHER PUBLICATIONS

Strackosch, G.R.; "Vertical Transportation: Elevators and Escalators"; pp. 472–475; New York: 1983.

*Primary Examiner*—Kenneth Noland

[57] ABSTRACT

Horizontally moveable elevator cabs A–E are transferrable between the car frames (72) of two elevators HI, LO in adjacent hoistways which extend between at least three levels (GND, MID, SKY) of a building, and between the car frames and landings L, R at said levels. The vertical movement of cars in the hoistways is synchronized, and transfer of elevator cabs between landings and car frames is simultaneous.

21 Claims, 13 Drawing Sheets

| FIG.54A | FIG.54B |
|---|---|

TRNSFR CTRL
207
208
TRNSFR
A R DFC
A L DFC
B R DFC
B L DFC
C R DFC
C L DFC
D R DFC
D L DFC
E R DFC
E L DFC
211
CTRL=XXXXXX1
212
213
SET ERR 4
UNLCK CAB HI
UNLCK CAB LO
214
CTRL=XXX001
CTRL=XXX011
CTRL=XXX101
END
CTRL=39
CTRL=37
219
230
235
249
250
236
247
Y
N (FIG.37)
(FIG.1)

SYNCHRONOUS ELEVATOR SHUTTLE SYSTEM

TECHNICAL FIELD

This invention relates to a high-traffic-volume, synchronous elevator shuttle system extending between three or more levels, with off-hoistway loading and unloading of passengers, and with full utilization of all hoistways.

BACKGROUND ART

The sheer weight of the rope in the hoisting system of a conventional elevator limits the practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and power consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in a commonly owned, copending U.S. patent application Ser. No. (Attorney Docket No. OT-2230), filed contemporaneously herewith. However, the system of that application has a single cab transferring among multiple hoistways, the hoistways in which a cab is not currently being moved being idle, thus wasting core.

Since the loading and unloading of passengers takes considerable time, in contrast with high speed express runs of elevators, another way to increase hoistway utilization, thereby decreasing core requirements, includes moving the elevator cab out of the hoistway for unloading and loading, as is described in a commonly owned, copending U.S. patent application Ser. No. (Attorney Docket No. OT-2297), filed contemporaneously herewith. Although the system of this application is very effective, it is limited to transport between two levels only.

DISCLOSURE OF INVENTION

Objects of the invention include provision of an elevator system which can extend between more than two levels, whereby to achieve moving passengers distances nearly double the distance limitation imposed by a roping system, that maximizes utilization of the hoistway, and that accommodates off-hoistway loading and unloading of passengers.

According to the present invention, an elevator system including at least two hoistways, each having a car frame moveable therein, and a plurality of horizontally moveable elevator cabs, simultaneously loads one cab from a landing onto a car frame and moves a cab from that car frame onto another car frame. According further to the invention, a cab on the second car frame can also be moved, simultaneously with the others, to another landing. According to the invention, passengers are loaded into a cab before the cab is moved onto a car frame, and are unloaded from a cab after the cab is off loaded from a car frame. According to the invention, cabs are loaded at landings, moved to a car frame, the car frame is moved to another floor, the cab is moved to another car frame, and the cab is then moved to a third floor, whence it is moved to a landing for unloading. According to the invention, cabs are moved synchronously between landings in a fashion so that traffic is handled between a first and second level and between a second and third level, as well as between the first and third level, in both directions, on a regular basis; in further accord with the invention, the synchronized travel is so arranged that a cab leaving for a specific destination always leaves from the same origin landing and always arrives at the same destination landing. According to the invention still further, the cabs may be double deck cabs so that passengers leaving for a destination can leave from either of two landings, one immediately above the other, and always arrive at two corresponding landings, one above the other. According to the invention further, double deck operation can be achieved so that a cab leaves for a given destination from an upper landing in between leaving for the same destination from a lower landing, on a repetitive cyclic basis. In still further accord with the invention, an elevator cab that is transferred through a multi-level multi-shaft system in a synchronized fashion always traces the same path from landing to landing to landing, etc., in a repetitive basis.

The invention can be employed with three, four or more landings if desired. The invention achieves a very high utilization of each hoistway, particularly when operated in the double deck mode, and also permits frequent departures for any given destination from any given origin. The double deck embodiment is extremely useful in saving core with no deterioration of passenger service.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 41:
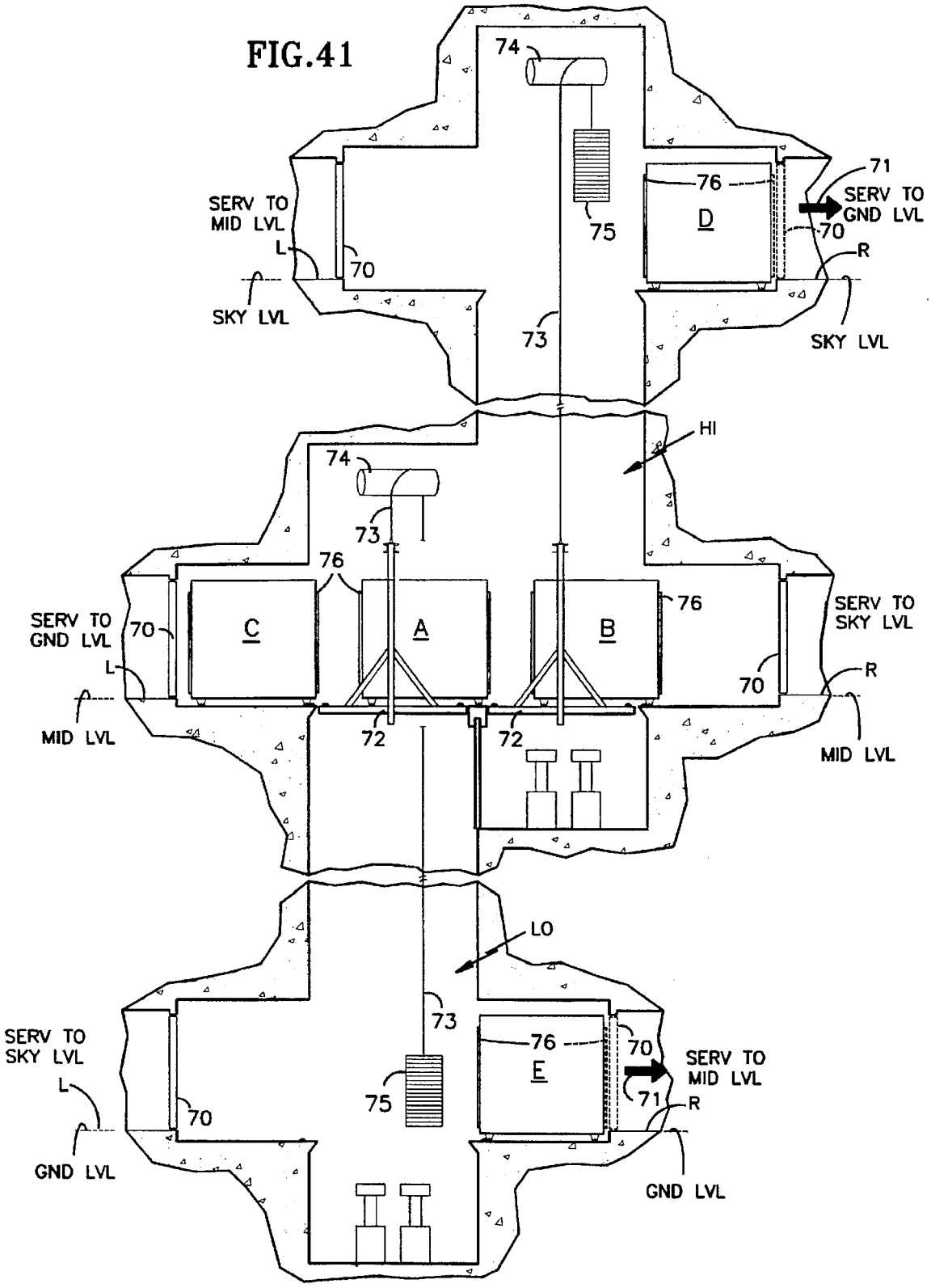
FIG. 41 is a simplified, broken away side elevation view of the synchronized shuttle elevators described in FIGS. 1–40.

Referring first to FIG. 41 (sheet 4), a synchronized shuttle elevator system of one embodiment of the invention includes two elevators LO, HI, extending between three levels GND, MID, SKY of a building, each level having a right landing area R and a left landing area L, and having hoistway doors 70, the doors 70 for all of the left landing areas and the mid level right landing area being shown full to indicate that they are closed, and the hoistway doors 70 for the right landing areas of the sky level and the ground level being shown dotted to indicate they are open.

Each elevator LO, HI includes a car having a car frame 72 suspended by a roping system 73 which is driven by a motor, sheave and brake system 74 along with a counterweight 75, in the usual fashion. Hereinafter, for simplicity, the elevator car frames, as well as each entire elevator are referred to by their designations LO, HI, and are referred to simply as cars.

In FIG. 41, there are five elevator cabs A–E, each of which has elevator doors 76 on both the left (L) and right (R) sides. The elevator doors 76 for cabs A–C are shown solid, indicating they are closed. The right elevator doors for cabs D and E are shown dotted to indicate they are open, whereas the left elevator doors for these cabs are shown solid to indicate that they are closed. As in the usual case, when a cab is positioned at a landing, the elevator doors are coupled to the hoistway doors and therefore opening and closing of the elevator cab doors is accompanied by opening and closing of the adjacent hoistway doors; herein, reference to opening or closing of doors means the cab doors and the hoistway doors adjacent the car in question. A pair of arrows 71 indicate that the elevator cab doors and hoistway doors are open at the right landing area of the sky level and ground level; the arrows are utilized to illustrate that fact in FIGS. 1–40, 42–51, and 60–67, as described hereinafter.

FIG. 41 depicts cabs D and E at the sky and ground levels, with their doors open, allowing passengers to exchange between the cab and the landing. FIG. 41 also depicts cabs A–C being transferred toward the right: cab C is leaving the mid-level left landing (MID L) and boarding the car frame 72 of the low elevator (LO); cab A is leaving the car frame 72 of the low elevator, crossing a sill 78 and entering onto the car frame 72 of the high elevator (HI); cab B is leaving the car frame 72 of the high elevator (HI) and entering onto the mid-level right landing (MID R). In a few seconds following the time depicted in FIG. 41, cab B will be fully on the MID R landing (similar to cabs D and E in FIG. 41), cab C will be fully disposed on the LO car and cab A will be fully disposed on the HI car. The manner of transferring the cabs between the cars and landings is described with respect to FIG. 59 hereinafter.

One of the features of the present invention is that the synchronized operation in accordance herewith allows permanently designating each landing with a singular, unique destination, to which a car leaving that landing will always travel, as indicated by the legends on FIG. 41: a cab leaving SKY L will always go to the mid-level (MID R, as described hereinafter), and so forth; a cab leaving SKY R will always travel to the ground level (GND R, as described hereinafter); this feature of the invention becomes more apparent with respect to FIGS. 1–40 and 51.

Figure 1:
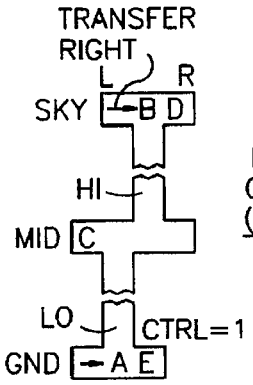
FIGS. 1–40 are simplified illustrations of the synchronized operation of a pair of shuttle elevators according to one embodiment of the invention.

The operation of the invention is described beginning in FIG. 1 with a condition where cab A is at the ground level in the low elevator; cab E is at the GND R landing; cab C is at the MID L landing; cab D is at the SKY R landing; and cab B is at the sky level in the HI car. The rightward-pointing arrows at the sky and ground levels indicate that cabs B and D and cabs A and E have just transferred to the right. This transfer has occurred during a period defined by a control clock as period No. 1 and referred to herein as CRTL=1. Similarly, each of FIGS. 1–40 depict actions, positions and conditions that occur in like numbered periods of the control clock. As is seen, in each of the odd numbered FIGS. 1–39, transfer of cabs occurs, to the right or to the left, onto and off of landings and cars, as indicated by the arrows in each of the odd numbered figures. In each of the even numbered FIGS. 2–40, the high and low elevator cars run in mutually opposite, vertical directions as indicated by the vertical arrows in each of the even numbered figures, and certain doors open and other doors close as indicated by the horizontal arrows in each of the even numbered figures.

Figure 2:
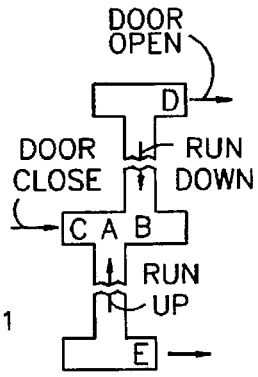
Figure 3:
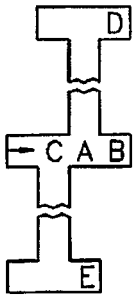
Figure 4:
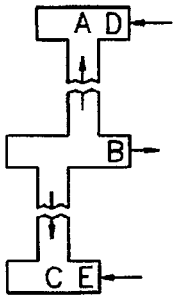
Figure 5:
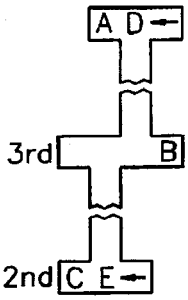
Figure 6:
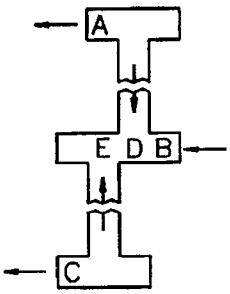
Figure 7:
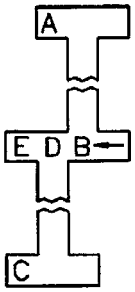

Referring to FIG. 2, cab A has traveled upwardly and cab B has traveled downwardly so that both are at mid-level. The door to cab C closes and the doors to cabs D and E open. Then, in FIG. 3, cabs C, A and B are all transferred to the right (as depicted in FIG. 41), and the doors to cabs D and E remain open. In FIG. 4, the doors to cab B are opened to allow passengers to emerge on the mid-level, while the doors to cab D and E are closed to prepare those cabs to be transferred. The door opening and closing occurs while cabs A and C are moving upwardly and downwardly in the high and low cars, respectively. In FIG. 5, cars A and D are transferred to the left at the sky level and cars C and E are transferred to the left at the ground level. In this particular embodiment, the cars at the ground level and the sky level are transferred to the left at the same time and to the right at the same time, in each instance; in other embodiments, they need not be. In FIG. 6, the doors to cabs A and C are opened to allow passengers to emerge therefrom; the passengers emerging from cab A at the sky level are those that were in cab A at the ground level, as shown in FIG. 1. Thus, these passengers have traveled from the ground level to the mid-level in the LO car, transferred to the HI car, and then traveled upwardly in the HI car to the sky level. The passengers emerging from cab C, on the other hand, are those that were entering the cab from the mid-level at the time depicted in FIG. 1. In FIG. 6, the door to cab B closes in preparation for transferring cab B to the high car in FIG. 7 as cabs E, D and B are shifted to the left.

The operation thus described continues to progress, each cab leaving a particular landing and traveling the same particular route to another landing, each cab following the same route as the cab ahead of it, in turn.

Figure 35:
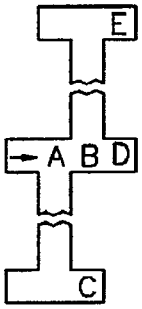
Figure 36:
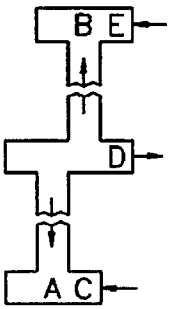
Figure 37:
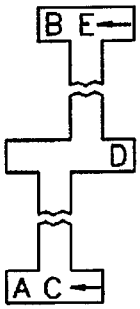
Figure 38:
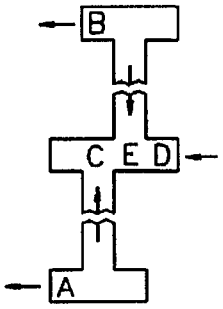
Figure 39:
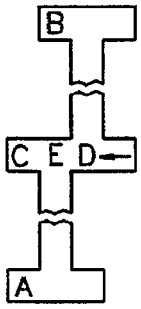
Figure 40:
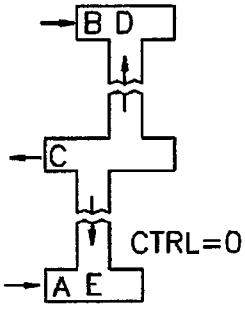

Referring to FIG. 36, cab A travels downwardly in the low elevator to the ground level, and then is shifted to the right along with cab C as depicted in FIG. 37; then the door to cab A opens allowing its passengers to exit as depicted in FIG. 38. In FIG. 40, the doors to cab A are closed in preparation of being shifted to the right as depicted in FIG. 1, and described hereinbefore. Then the processes illustrated in FIGS. 1–40 repeat, continuously, as long as the synchronized shuttle elevator system of the invention is in operation. As two of the cabs travel up or down, the other three cabs are standing at a landing with the doors open to allow exchange of passengers with the landings. A car will depart from a given landing once each eight control periods e.g, for CTRL=0, 8, 16, 24, 32, and 0 once again. During normal operation, each cab traverses the route illustrated in FIG. 52: GND-SKY; SKY-MID; MID-SKY; SKY-GND; GND-MID; MID-GND.

Figure 34:
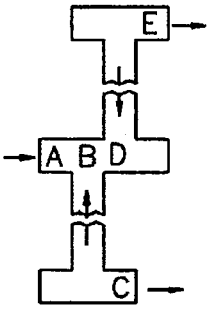
Figure 42:
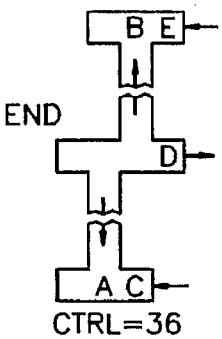
FIGS. 42–46 are simplified illustrations of the synchronized operation of a pair of shuttle elevators according to one embodiment of the invention, when shutting the system down (e.g., before a weekend).
Figure 43:
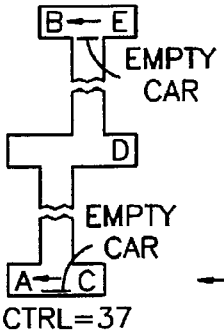
Figure 45:
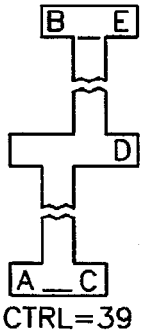
Figure 46:
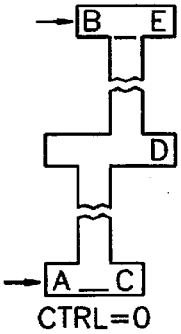

If the system is to shut down, such as when fewer systems are necessary on a weekend, or for any other reason, slightly different operations are required so as to lead all cabs to a landing to permit passengers to exit onto a landing. In the simplified embodiment herein, shutting down the system (as at the end of the week) is only permitted beginning with control period 34 by shutting off the service signs (e.g., service to ground LEVEL, FIG. 41); operation in control periods 34 and 35 is otherwise the same as shown in FIGS. 34 and 35. FIG. 42 is identical to FIG. 36, except that as the door of cab D closes, it will be accompanied by an alarm and the absence of the service signs, so that no passengers should enter cab D at that time. Operation in control period 37 is modified as shown in FIG. 43. In particular, cabs C and E are not released from the building and are therefore not transferred to the left as in FIG. 37; instead, cabs A and B are transferred to the left and cabs E and C remain in place at the sky right landing and the ground right landing, respectively. However, there will be no passengers caught in cabs E and C as the doors close because there is an alarm during control period 34 when the doors of cabs E and C are opened to allow passengers to exit to the landings, as in FIG. 34. By alarm is meant an irritating rasping noise that will scare people and cause them to not enter the elevator, as well as possibly having the lighting within the cab flickering or flashing on and off. In addition, the service signs have been shut off in control period 34 in order to make it appear that the elevator is going out of service. The doors can close at very low speed with the lights off and the alarm on, if necessary, in order to coach passengers away from the cab. In any event, as shown in FIG. 43, cabs C and E remain in place with their doors closed during control period 37. In control period 38, the doors for cabs A and B open in order to allow the passengers to exit. The alarms will be on and the service signs will be off, as described for cabs C and E hereinbefore, so that passengers will not get on cabs A and B at this time. During control period 39 as seen in FIG. 45, cabs are standing still, cabs C, D and E have their doors closed, and cabs A and B have their doors open to permit passengers to exit, with the alarms on. Then in control period 0, as seen in FIG. 46, the doors for cabs A and B are closed, amidst alarms as described hereinbefore. On the other hand, if the traction system (motor and brake) is inadequate to hold an empty cab against the upward pull of the counterweight, two cabs can be left on the car frames when shut down. In such a case, all the cabs must first be emptied without reloading, as described above, simply by passing through a pattern (e.g., all of FIGS. 30–37) with alarms at each landing.

Figure 47:
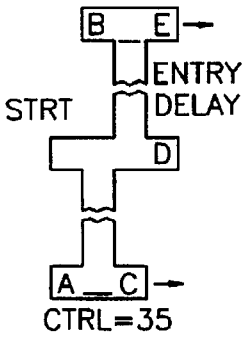
FIGS. 47–50 are simplified illustrations of the synchronized operation of a pair of shuttle elevators according to one embodiment of the invention, when starting the system up (e.g., after a weekend).

To start the system up, assuming it is shut down under conditions shown in FIG. 46, all that is needed is to open the doors to allow passengers to enter cabs E and C, transfer those cabs to the left, and begin normal operation. To achieve this, the control is forced to period 35, the doors to cab E and C are open as shown in FIG. 47, and the service signs are turned on indicating the destination for cabs leaving each of the landings. To allow time for passengers to enter the cabs, a delay is provided before allowing the controller to advance to period 36, shown in FIG. 48. In control period 36, the doors to cabs C and E are closed and the door to cab D is opened (the same as in normal operation as depicted in FIG. 36). Then in control period 37, cabs C and E are transferred to the left; however, cabs A and B are already in the left position, and therefore are not transferred. At the end of control period 37, conditions are the same as they are at the end of control period 37 during normal operation (FIG. 37). Then, beginning with control period 38 (FIG. 50), operation is exactly the same as during normal operation (as illustrated in FIG. 38). All of these operations are explained in more detail with respect to the controls therefor, hereinafter.

Figure 53:
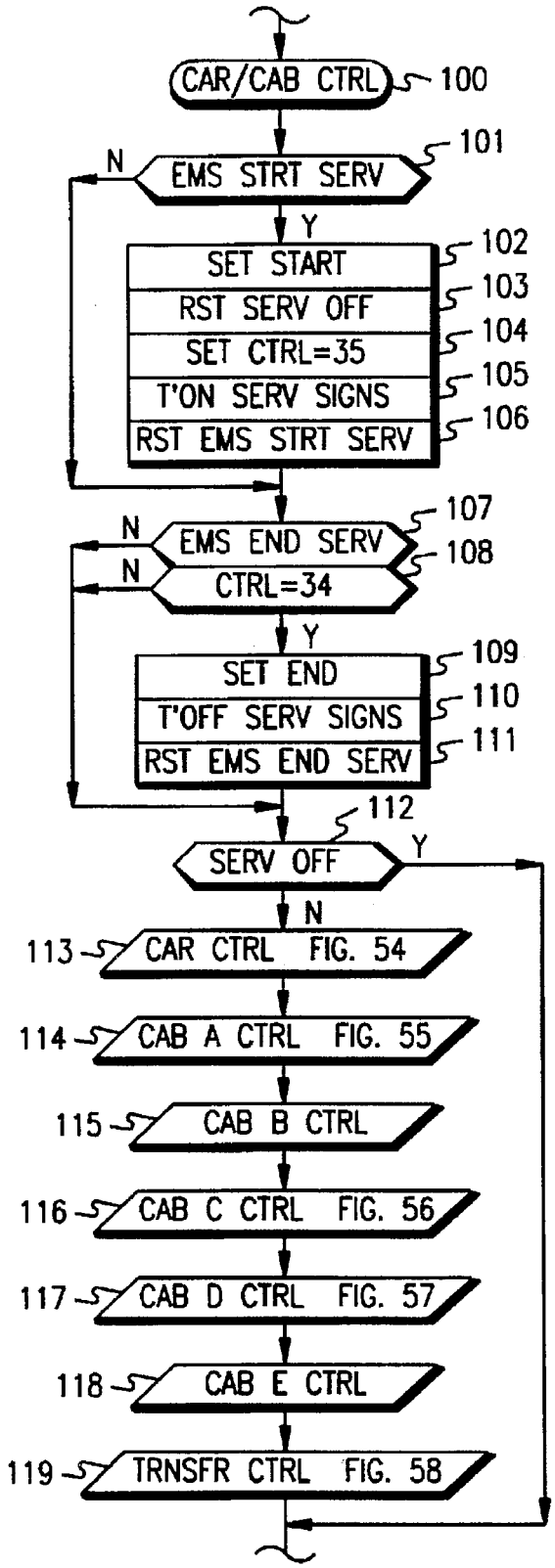
FIG. 53 is a logic flow diagram of a car/cab control program to cause the synchronized shuttle elevators of FIG. 41 to operate in accordance with FIGS. 1–40, and 42–52.

Referring now to FIG. 53, a combined car/cab control routine determines whether service is normal, off, beginning or ending. It also calls the subroutines that perform the specialized synchronized control over the elevator cars and the cabs. The routine is reached through an entry point 100 and a first test 101 determines if the elevator management system (EMS) has requested the start-up of service in this two-elevator shuttle system, or not. If it has, a first step 102 sets a "start" flag and a second step 103 resets a "service off" flag. The control counter (described more fully hereinafter) is set to 35 by a step 104 so as to cause startup, beginning as described hereinbefore with respect to FIG. 47. All of the service signs (legends, FIG. 41) are turned on by a step 105, and a step 106 resets the EMS request to start service. On the other hand, if the start of service has not been ordered by the EMS, a negative result of test 101 bypasses all of the steps 102–106.

A test 107 determines if the EMS has ordered the end of service. If it has, a test 108 determines if the control is set to the 34th period. If it is, an affirmative result of test 108 reaches a step 109 which sets an "end" flag, a step 110 which turns off all the service signs, and a step 111 which resets the EMS request to end service. In this simple embodiment, if the control is at other than the 34th period, the end of service is not commenced since this embodiment utilizes a very simple process to assure that all passengers leave the cabs before the system is shut down. However, the invention may be practiced in a more complex system which recognizes any control period equivalent to period 34 and its relationship to the positioning of the cars. For instance, at period 2, cab E is in the same position and condition as cab C is in period 34. Therefore, ending could commence with the second period if all of the activity of cab E were made to follow the same sequence during the ending of the period as is true for cab C in this embodiment, and similarly with respect to all of the other cabs. If it is not control period 34 or if the EMS has not requested the end of service, the steps 109–111 are bypassed.

A test 112 determines if service has in fact been ended and is now off. If not, a number of subroutines are performed so as to control the processes described hereinbefore with respect to FIGS. 1–51. A car control subroutine 113 controls the direction and running of the high and low elevator cars and locking them to the building at appropriate times. A series of subroutines 114–118, one for each cab, control the opening and closing of cab doors (and therefore also hoistway doors), and the sounding of alarms when operation is ending. A transfer control subroutine 119 controls the transfer of the cabs from right to left and from left to right, in the manner described with respect to FIGS. 1–42, hereinbefore. All of the subroutines 113–119 can be performed quite quickly, even though the task of each may not be accomplished in a single performance of the subroutine. Conceptually, the subroutines operate in the order of the car control first, then the cab controls and the transfer control last; but the order of actually performing the subroutines is irrelevant since they are fully interlocked with tests. Whenever service is off, an affirmative result of test 112 causes all of the subroutines 113–119 to be bypassed. If desired, other programming may be performed between any two of the subroutines 113–199, provided that each has a test similar to test 112 at the beginning thereof to bypass it when service is off. All of this is well within the skill of the art and irrelevant to the present invention.

Figures 54, 54A:
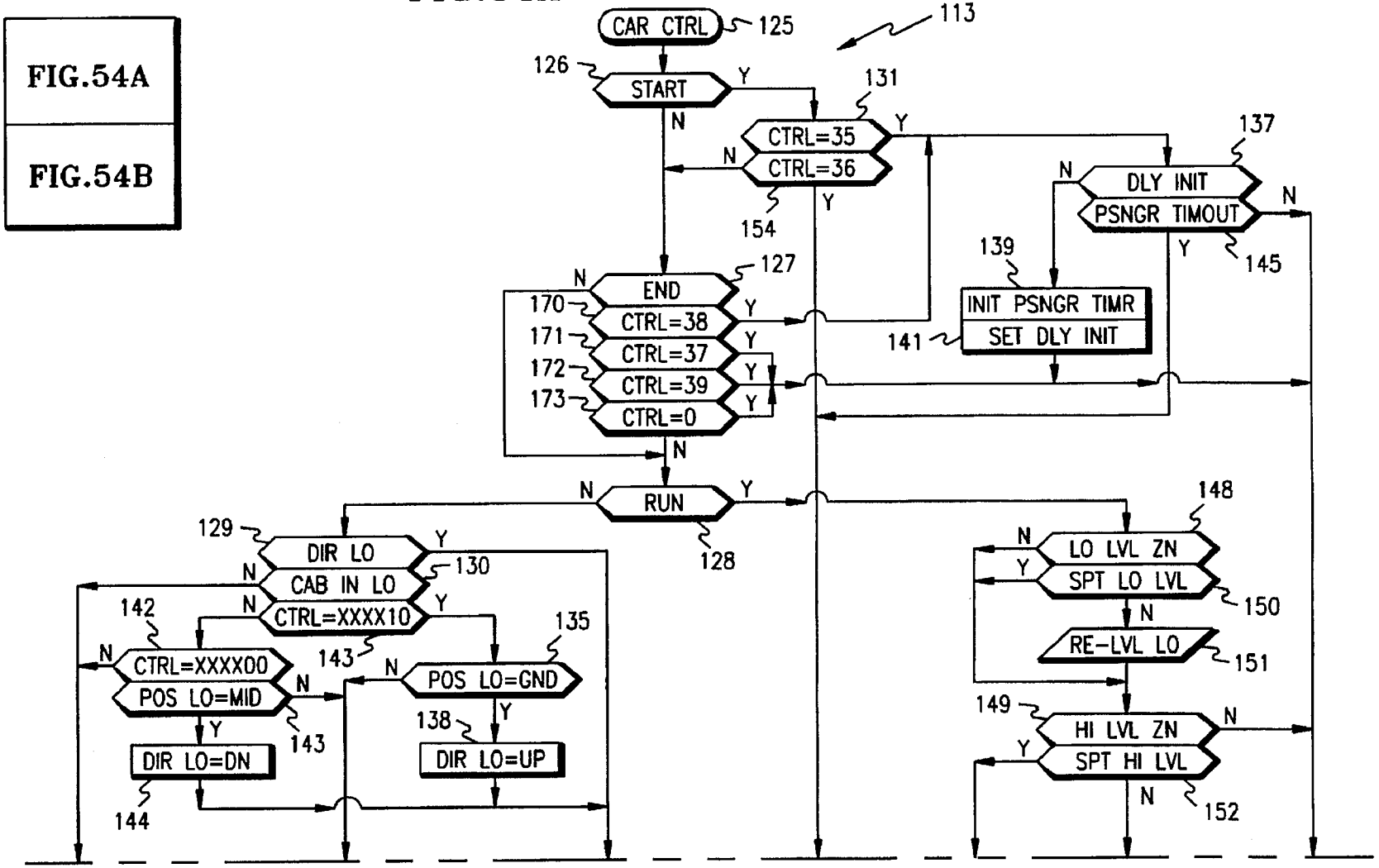
FIG. 54 is a logic flow diagram of a car control subroutine for use in the routine of FIG. 53.
Figure 54B:
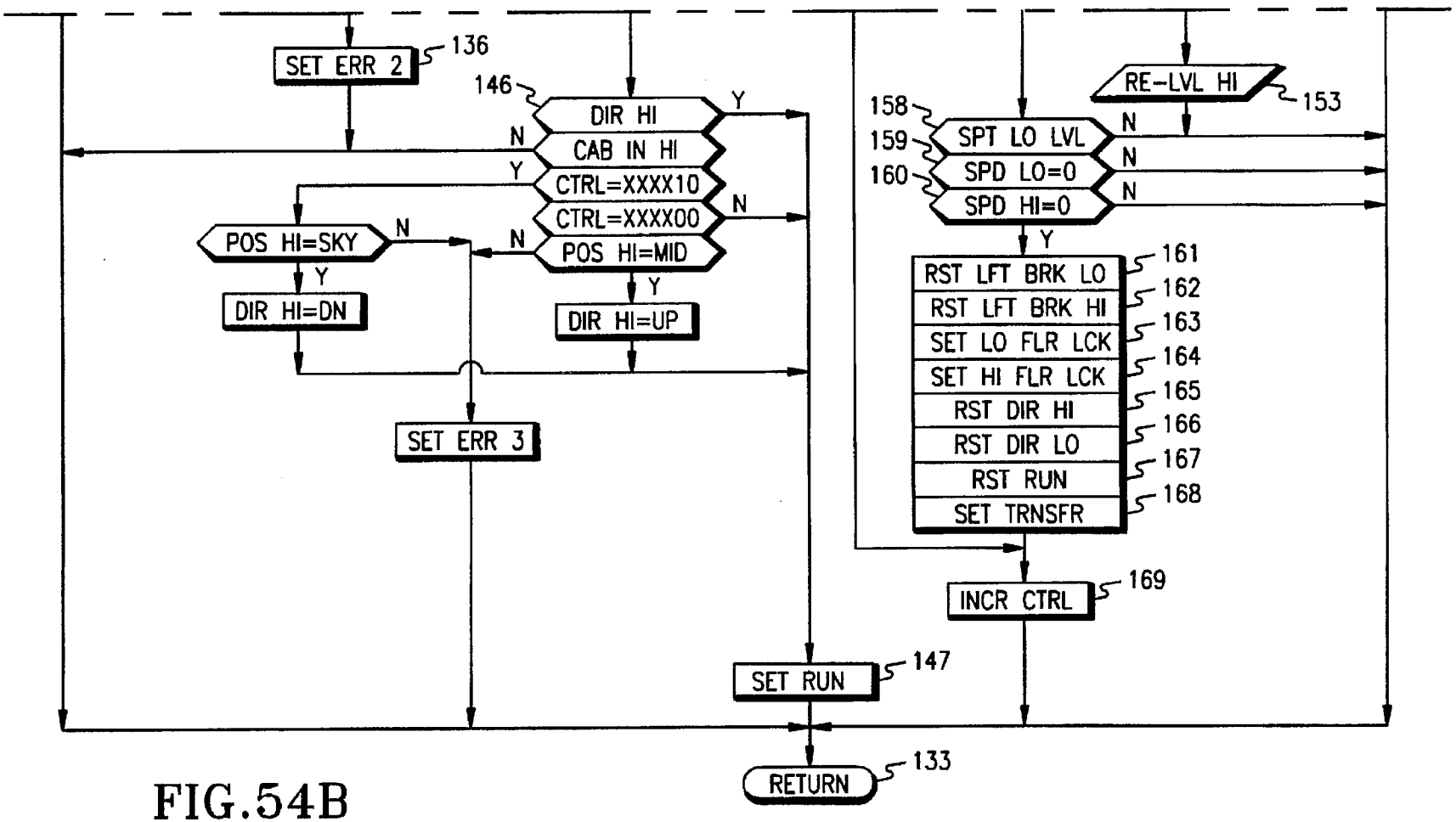

In the description of all of the subroutines 113–118, it is first assumed that normal operation obtains, rather than starting or ending of normal operation. The car control subroutine 113 is reached in FIG. 54 through an entry point 125 and a first test 126 determines whether the start flag (step 102, FIG. 53) has been set or not. Under the assumption of normal operation, it has not been set, and a negative result of test 126 reaches a test 127 to determine if the end flag (step 109, FIG. 53) has been set or not. Under the assumption, it has not, so a negative result of test 127 reaches a test 128 to determine if the high and low elevators have been enabled to run yet or not. As is illustrated hereinafter, during the first portion of the even periods of the control, the elevators are not enabled to run, and a negative result of test 128 reaches a test 129 to see if direction has been established for the low elevator, or not. Initially, it will not have, so a negative result of test 129 reaches a test 130 to see if there is a cab in the low elevator. If there is not, then this means that cabs are being transferred and not yet firmly in place on the elevator. Therefore, a negative result of test 130 causes other programming to be reverted to through a return point 133. In a subsequent pass through the subroutine of FIG. 54, eventually a cab will be locked in place on the low car, such as in commonly owned, copending U.S. patent application Ser. No. (Attorney Docket No. OT-2284), filed contemporaneously herewith, and the interlock switch signal will indicate that a cab is in the low car. Then an affirmative result of the test 130 will reach a test 134 to determine if the control is set to any of the numbers for which the lowest two order bits are "10". This will occur for control periods 2, 6, 10, 14, etc. Reference to like numbered figures indicate that during these periods, the low car is at the ground level and its direction must be set to up, so that it can advance to the mid level. Therefore, an affirmative result of test 134 reaches a test 135 to verify that the position of the low car (determined by a well-known primary position transducer, or the like) indicates that the low car is at the ground level. If it does not, this means something has gone wrong: either the control is out of synch, the position sensor on the low car is broken, or the car is for some reason in the wrong position. In any event, a negative result of test 135 reaches a step 136 to set an error (designated as error two in this embodiment), and other programming is reverted to through the return point 133. It is assumed that setting of error two will cause other things to happen so that the subroutine of FIG. 54 is not reentered until the error is cleared up. On the other hand, if the low car is at the ground level, an affirmative result of test 135 will reach a step 138 to set the direction for the low car equal to up.

Figure 8:
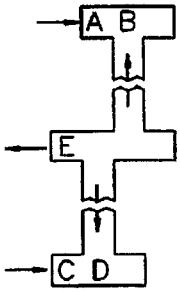
Figure 9:
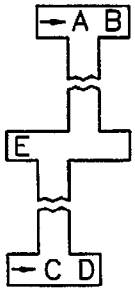
Figure 10:
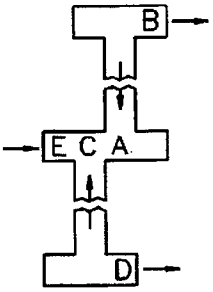
Figure 11:
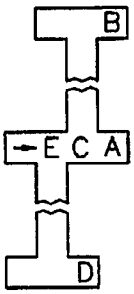
Figure 12:
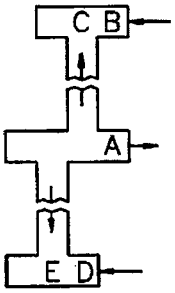
Figure 13:
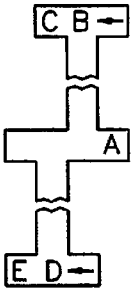

If test 134 is negative, then a test 142 determines whether the control is set to a number of which the two low order bits are "00". If not, then the system is not in a control period in which direction for the elevator cars is to be set. Therefore, a negative result of test 142 causes other programming to be reached through the return point 133. On the other hand, if the control is set at a number having low order bits "00", an affirmative result of test 142 reaches a test 143 to see if the low car is at the mid level, which it should be at the start of the 4th, 8th, 12th (and so forth) periods, as indicated in FIGS. 4, 8, 12 and so forth. If it is not, a negative result of test 143 will reach step 136 to set the error. But if the low car is at the mid-level, then its next run must be down, so an affirmative result of test 143 reaches a step 144 to set the direction of the low car down.

Once direction has been set for the low car, a test 142 is reached to see if direction has been set for the high car. If it has not, a negative result of test 142 reaches a series of steps and tests which are equivalent in all respects to the steps and tests 130–144 described hereinbefore for the low car, which require no further description. In some subsequent pass through the subroutine of FIG. 54, with the control in an appropriate period, direction will have been established for both the low car and the high car so affirmative results of tests 129 and 146 reach a step 147 which sets a "run" flag. This causes the motion controller of the high car and the low car to cause the car to begin a run, in the direction established by the subroutine of FIG. 54. Once the "run" flag is set, each car will begin moving in an appropriate direction under the command of a car motion controller, in the usual fashion.

Figure 52:
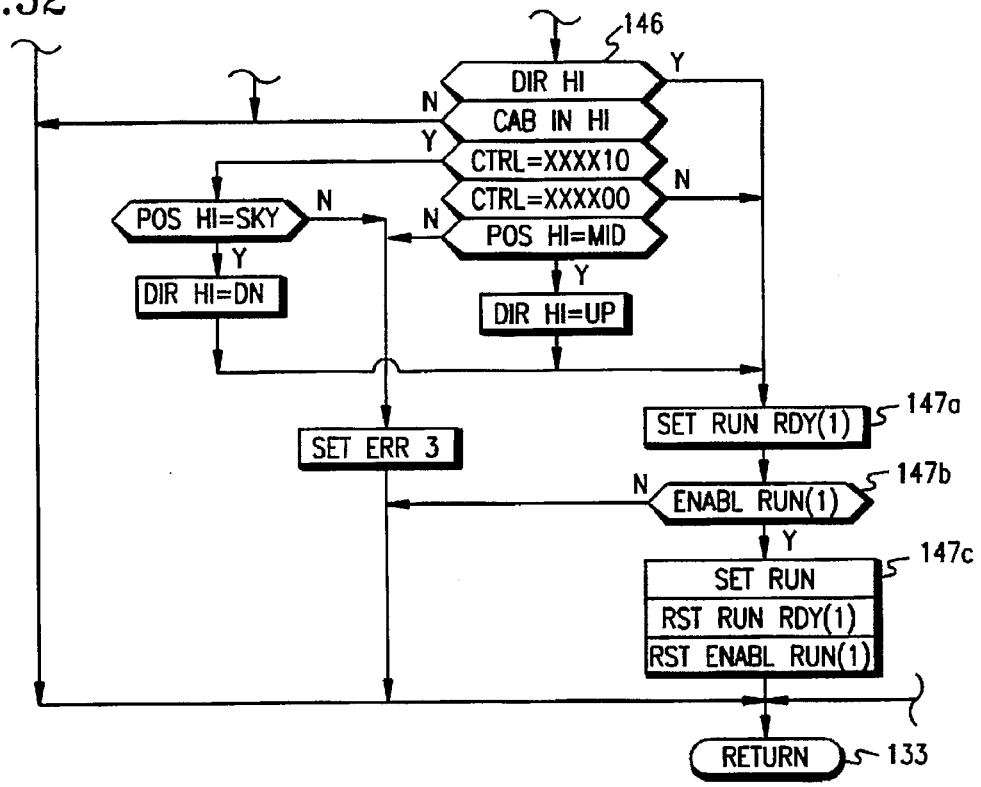
FIG. 52 is a partial logic flow diagram illustrating a bank-synchronized modification to FIG. 54.

If the LO and HI car herein are part of a synchronized bank of shuttle elevators, as described in a commonly owned, copending U.S. patent application Ser. No. (Attorney Docket No. OT-2293), filed contemporaneously herewith, the setting of "RUN" may be synchronized with a group controller, as shown in FIG. 52. Therein, instead of setting the "run" flag, a step **147*a* sets a "run ready car 1" flag, which the group controller can then return as an "enable run, car 1" flag, when the appropriate time arrives, which a test 147*b* responds to, to set the "run" flag and reset the "run ready, car 1" flag and the "enable run, car 1**" flag.

When the car nears the end of the run, it will reach zones, normally referred to as outer and inner door zones, which in this case are referred to as levelling zones. As soon as the run flag is set in the step 147, the next subsequent pass through the subroutine of FIG. 54 finds tests 126 and 127 negative and test 128 affirmative. This reaches a test 148 to determine if the low car has reached its leveling zone (equivalent to an outer door zone) or not. Initially, as the car is running along, it will not so a negative result of test 148 reaches a test 149 to see if the high car has reached its leveling zone. Initially it will not so a negative result of test 149 causes other programming to be reverted to through the return point 133. Each subsequent pass through the subroutine of FIG. 54 will be similar until, finally, one or another of the cars reaches a leveling zone. If the low car reaches its leveling zone, an affirmative result of test 148 reaches a test 150 to see if the secondary position transducer (SPT) indicates that the low car is level with the landing which it is at. This is equivalent to the leveling that occurs at landings of ordinary elevators. If it is not level, a normal releveling subroutine 151 for the low elevator is reached to relevel the low elevator at its current landing. But if the SPT indicates that the low car is level with its landing, the subroutine 151 is bypassed. Similarly, if test 149 indicates that the high car is within its leveling zone, then a test 152 determines if the car is level. If it is not, it is releveled by a subroutine 153; otherwise, the subroutine 153 is bypassed. If the test 152 indicates the high car is level, then a test 158 determines if the low car is also level (note that test 149 can be reached without the low car being level). If both cars are level, an affirmative result of test 158 reaches a pair of tests 159, 160 to determine if both cars are totally stopped. If they are, affirmative results of tests 159 and 160 reach a series of steps: steps 161 and 162 reset the lift brake command for both elevators, causing the brake to drop; steps 163 and 164 cause the low car and the high car to be locked to the floor of the building so that there will be no change in rope stretch as cabs are moved on and off the cars; steps 165 and 166 reset the direction for both the high car and the low car; a step 167 resets the "run" flag and a test 168 sets a "transfer" flag, indicating that cabs can now be transferred off the cars onto the landings, off the landings onto the cars, and between the cars. Once the steps 161–168 have all been performed, indicating that cabs have been transported between levels on the cars and are ready for transfer, a step 169 increments the control to an odd number.

Figure 48:
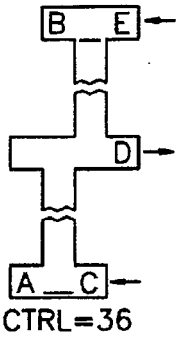
Figure 49:
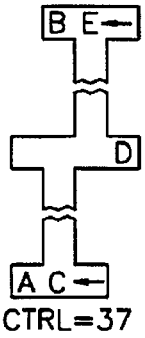
Figure 50:
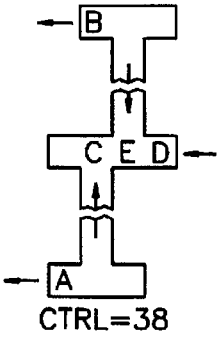

The description of FIG. 54 thus far is during normal operation. If the start flag has been set, an affirmative result of test 126 reaches a test 131 to determine if the control is set at 35. Initially it will be, since the control is set at 35 by step 104 (FIG. 53) to initiate operation. Therefore, an affirmative result of test 127 will reach a test 137 to determine if a delay time has been initiated or not. This is a period of time that will allow passengers sufficient time to enter cabs C and E (FIG. 47) before allowing the control to advance and close the doors to cabs C and E (FIG. 48). Normally, the doors will be open during the period of time in which the elevator cars make a round trip run, away from a level and then back to that level. Since no cars are moving during startup, a passenger entry delay time has to be provided. Initially, the delay will not have been initiated, so a negative result of test 137 reaches a step 139 to initiate the passenger timer and a step 141 to set a "delay initiation" flag so that a subsequent pass through the routine of FIG. 54 will find an affirmative result of test 137. Once the timer is initiated and the flag is set, other programming is reverted to through a return point 133.

In a subsequent pass through the car/cab control routine of FIG. 53, test 101 will be negative, test 107 will be negative, and test 112 will be negative once again reaching the car control subroutine 113 of FIG. 54. In this pass, tests 126, 131 and 137 will be affirmative, reaching a test 145 to determine if the passenger timer has timed out or not. Initially, it will not have timed out, so other programming is reverted to through the return point 133. This will continue during many passes through the subroutine of FIG. 54 until finally a suitable time frame (on the order of 15 seconds) will have elapsed so that all of the passengers who wish to enter, have probably entered cabs C and E. When this happens, an affirmative result of test 145 reaches the step 169 which increments the controller so that it advances to control period 36. Referring to FIG. 48, this causes the doors of cabs C and E to be closed and the door of cab D to be opened. In the next pass through the subroutine of FIG. 54, test 126 is affirmative but now test 131 is negative, reaching a test 154 to determine if the control is at 36; it will be, so an affirmative result of step 154 reaches step 169 where the control is again incremented because no car function is performed in control period 36. And then, other programming is reverted to through the return point 133.

In the next pass through the car control subroutine 113, test 126 is affirmative, tests 131 and 154 are negative, and test 127 is negative. Then, operation is as described hereinbefore. That is, beginning with the control set to 37 (as in FIG. 49), the car control subroutine 113 operates the same during start as normally.

Assuming now that instead of the start flag being set, the end flag is set. A negative result of test 126 and an affirmative result of test 127 reaches a series of tests 170–173 to see if the control is set anywhere between 38 and 0. Since the "end" flag is set at control 34, the first few passes through the subroutine 113 will find negative results of all of the tests 170–173 so that operation of the car control subroutine 113 is the same as during normal operation. Eventually, control 38 is reached so an affirmative result of test 170 reaches the test 137 to determine if the passenger time out delay has been initiated or not. Initially, it will not so the steps 139 and 141 initiate the timer and set the "delay initiated" flag. Then other programming is reverted to through the return point 133, without incrementing the control at step 169. This causes the program to repetitively pass through an affirmative result of step 38 until an affirmative result of test 145 indicates that the passenger timeout time (necessary to allow passengers to exit cabs A and B see FIG. 44) has passed. Then, an affirmative result of test 145 reaches the step 169 to increment the control from 38 to 39.

When the control equals 37, an affirmative result of test 127 and a negative result of a test 170 will reach a test 171 which will be affirmative, simply causing other programming to be reverted to through the return point 133, since there is no car motion or other car function required during control period 37 when operation is ending. Subsequently, the control will be incremented within the transfer subroutine as described hereinafter; in the first pass through the car control subroutine 113 after the control is set at 38, an affirmative result of test 170 and test 178 will result in establishing a passenger delay, to allow time for passengers to exit cabs A and B in lieu of the running time of elevators, because the elevators do not run in control period 39 during the ending of normal operations. Initially, test 137 is negative reaching steps 139 and 141 to initiate passenger delay timer, and set the flag. Since the control is incremented from even to odd within this subroutine, all subsequent passes through tests 170 and 171 will reach test 137, which is affirmative, awaiting timeout at test 145. Prior to timeout, a negative result of test 145 will always simply cause other programming to be reverted to through the return point 133, without incrementing the control in step 169. Once the passenger timer times out, an affirmative result of test 145 reaches step 169 to increment the control to period 39. In the very next pass through the car control subroutine 113, an affirmative result of test 172 simply causes other programming to be reverted to through the return point 133, since there are no car control functions to be performed during the 39th control period when operation is ending. Eventually, the transfer subroutine will cause a control to advance from 39 to 0 and an affirmative result of test 173 will simply bypass the remainder of the subroutine of FIG. 113 to the return point 133. As is described hereinafter, all operation ceases in the first pass through the control transfer subroutine 119 when the operation is ending and the control is in the zero period.

Figure 14:
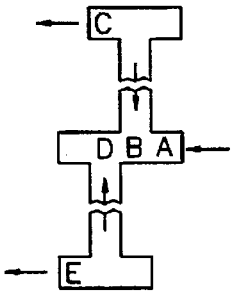
Figure 15:
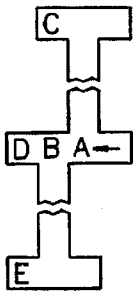
Figure 16:
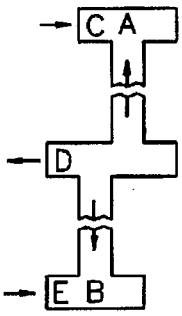
Figure 17:
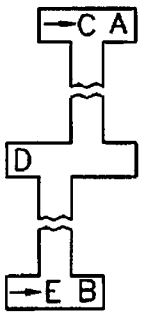
Figure 18:
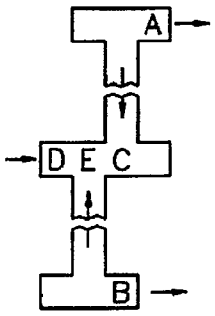
Figure 19:
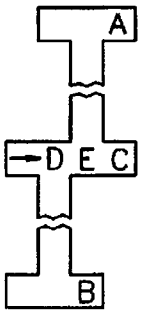
Figure 20:
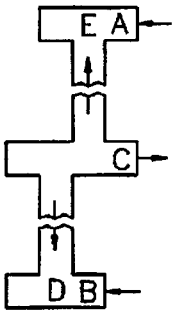
Figure 21:
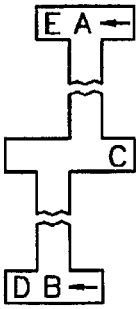
Figure 22:
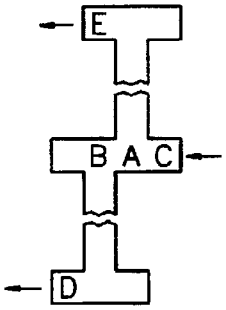
Figure 23:
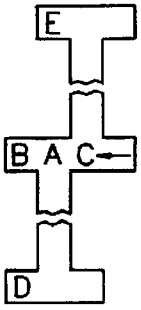
Figure 24:
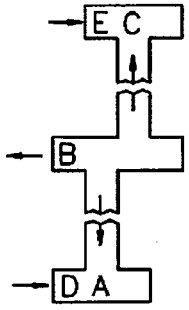
Figure 25:
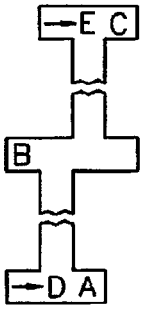
Figure 26:
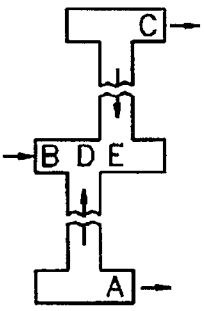
Figure 27:
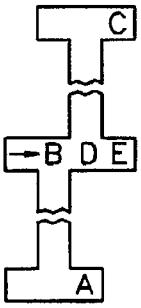
Figure 28:
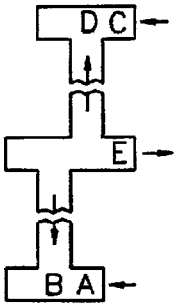
Figure 29:
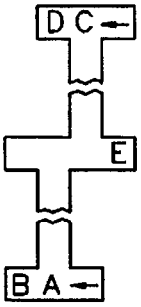
Figure 30:
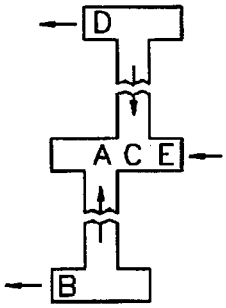
Figure 31:
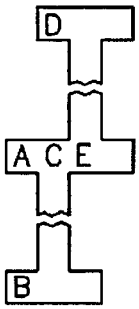
Figure 32:
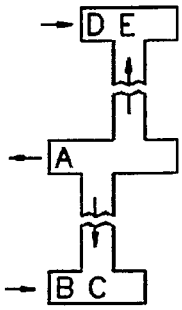
Figure 33:
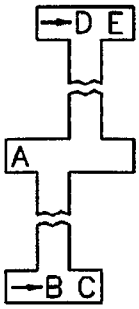
Figure 55:
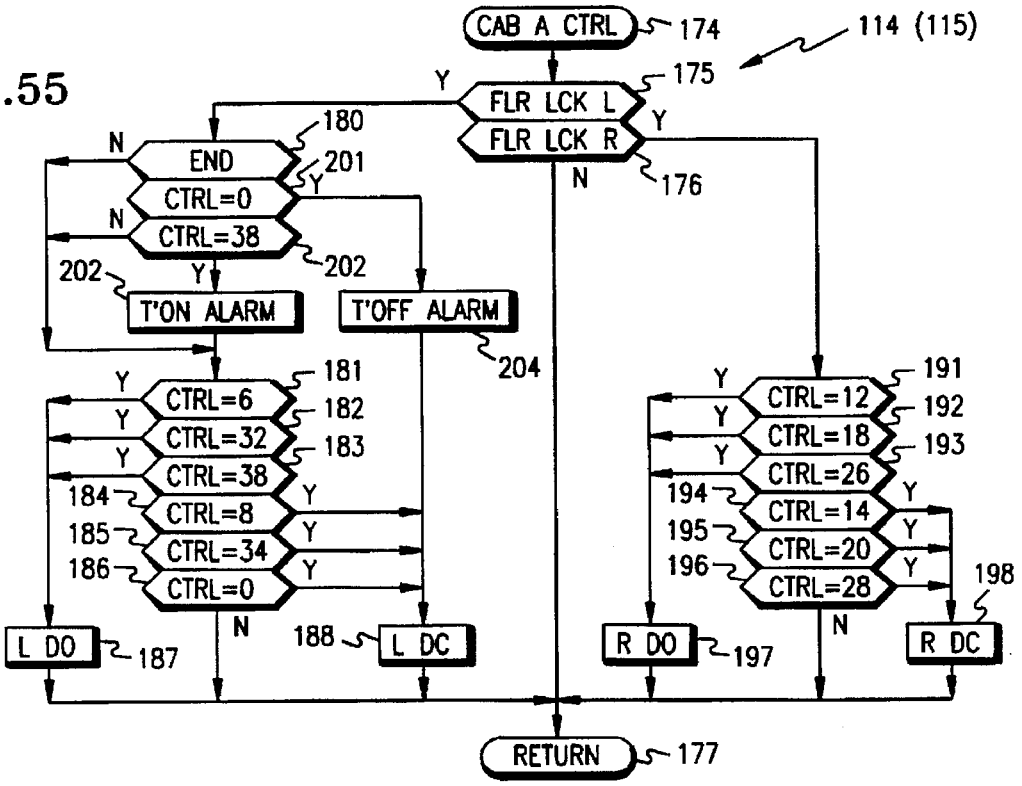
FIGS. 55–57 are logic flow diagrams of cab control subroutines for use in the routine of FIG. 53.

Referring to FIG. 55, the cab control subroutine 114 for cab A is reached through entry point 174 and a pair of tests 175, 176 determine if the cab is at a landing and locked to the floor (in a manner described hereinafter, or not). In this context, the locking to the floor takes place in a different manner at a right landing than at a left landing. In this embodiment, two different lock positions are used, one for the right and a different one for the left, so that the interlocking or safety that identifies the fact that the car is locked is different for the right than the left. This interlock may be no more than a microswitch which is closed only in response to full locking at the appropriate right or left position. If the car is not locked in either a right or left landing, the result of both tests 175, 176 will be negative, reaching a return point 177 so that there is no door opening or closing or alarm activity in cab A during that particular pass through the subroutine of FIG. 55. On the other hand, if cab A is locked at a left landing, an affirmative result of test 175 reaches a test 180 to determine if the end flag has been set or not. During normal operation, it will not be, so a negative result of test 180 reaches a series of tests 181–186 to determine if the control is set at any period which requires a left door to be opened, as seen in FIGS. 6, 32 and 38, or which requires a left door to be closed, as seen in FIGS. 8, 34 and 40. If any of tests 181–183 are affirmative, a step 187 will cause the left door open command in cab A. On the other hand, if any of tests 184–186 are affirmative, a step 188 will cause a left door close command in cab A. In a similar fashion, if cab A is locked at a right landing, a series of tests 191–193 determine if the control is set to a period requiring a right door open command in a step 197, and a series of tests 194–196 determine if a right door close command is required in a step 198. For instance, reference to FIGS. 12 and 14 show that the right hand door of cab A opens at control 12 and closes at control 14.

Figure 44:
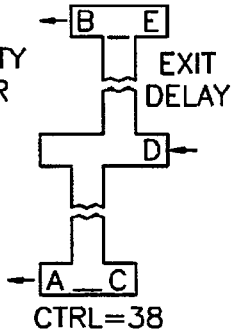

As seen in FIG. 44, if an end to normal operations has been commanded and the end flag has been set, the left doors of cab A are opened at control period 38 in order to let people out. To prevent others from entering the cab at that time, an alarm must sound along with possible lowering of light intensity and the like, to prevent other passengers from entering the cab. The service signs indicating the destination of a cab leaving the left landing would have already been shut off at control period 34 at step 110 in FIG. 53. In FIG. 55, an affirmative result of test 180 therefore reaches a pair of steps 201, 202 which cause a step 203 to turn on the alarm in control period 38 and a step 204 to turn off the alarm in control period 0 (FIG. 46).

The cab control subroutine 115 for cab B is identical to that for cab A except that the control periods tested in tests equivalent to tests 181–186 are 24, 30, 38, 26, 32 and 0, respectively. This can be seen by reference to FIGS. of the same number: the cab B left door is opened in FIGS. 24, 30 and 38 and closed in FIGS. 26, 32 and 40. Similarly, the control numbers tested for in tests equivalent to tests 191–196 are 4, 10, 18, 6, 12 and 20 because it can be seen that the cab B right door is opened in FIGS. 4, 10 and 18 and closed in FIGS. 6, 12 and 20.

Figure 56:
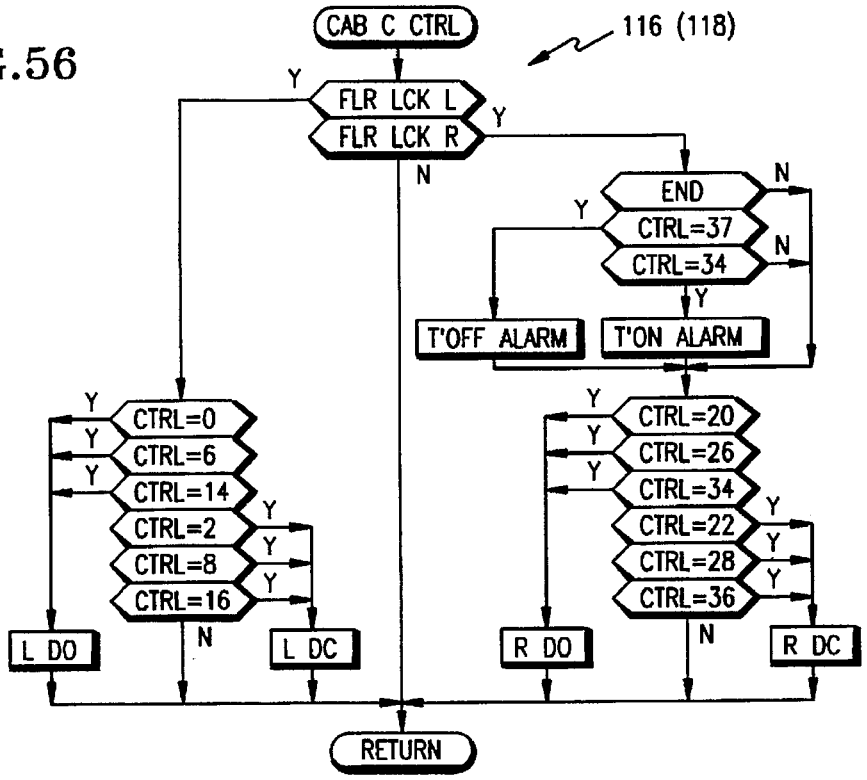

Referring to FIG. 56, the cab control routine 116 for cab C is the same as that for cab A except that the equivalent door numbers for the left doors are 0, 6, 14, 2, 8 and 16, the equivalent control numbers for the right doors are 20, 26, 34, 22, 28 and 36; and the alarm is turned on during an ending of normal operations in control period 34, and then turned off in control period 37. The cab control subroutine 118 for cab E is identical to that of cab C except the left door control numbers are 8, 14, 22, 10, 16 and 24; and the right door control numbers are 2, 28, 34, 4, 30 and 36. The alarm controls are identical.

Figure 57:
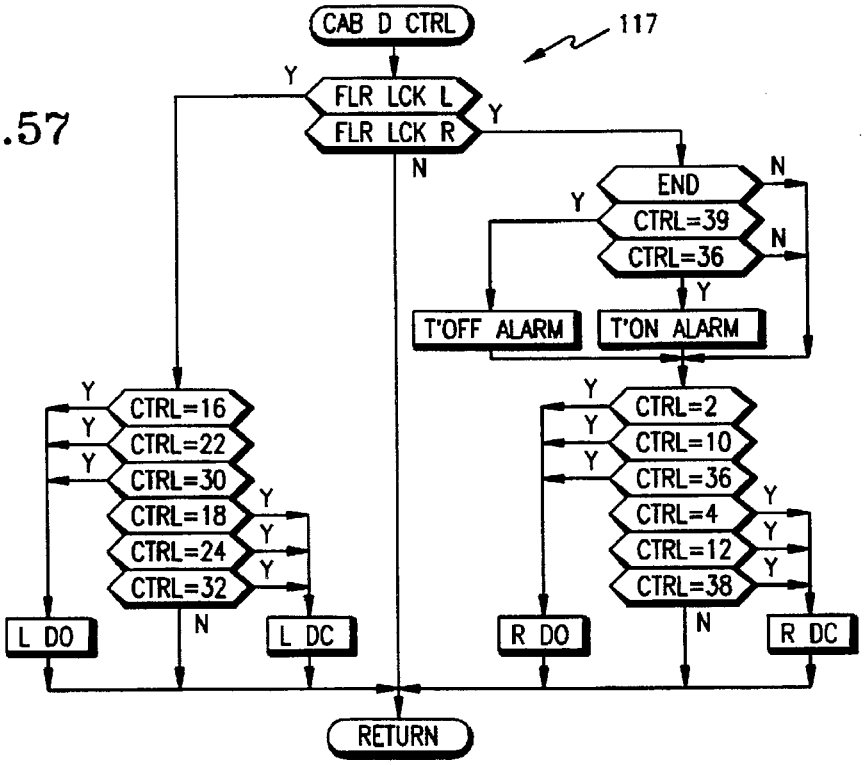

The cab control subroutine 117 for cab D, shown in FIG. 57, is identical to the cab control subroutine 116 for cab C shown in FIG. 56 except for the control numbers involved. The left door control numbers are 16, 22, 30, 18, 24 and 32; the right door control numbers are 2, 10, 36, 4, 12 and 38. The alarms are turned on at control 36 and turned off at control 39, because as seen in FIGS. 42 and 44, the right door of car D is open to let passengers out at control 36 and the door is closed at control 38.

Figures 58, 58A:
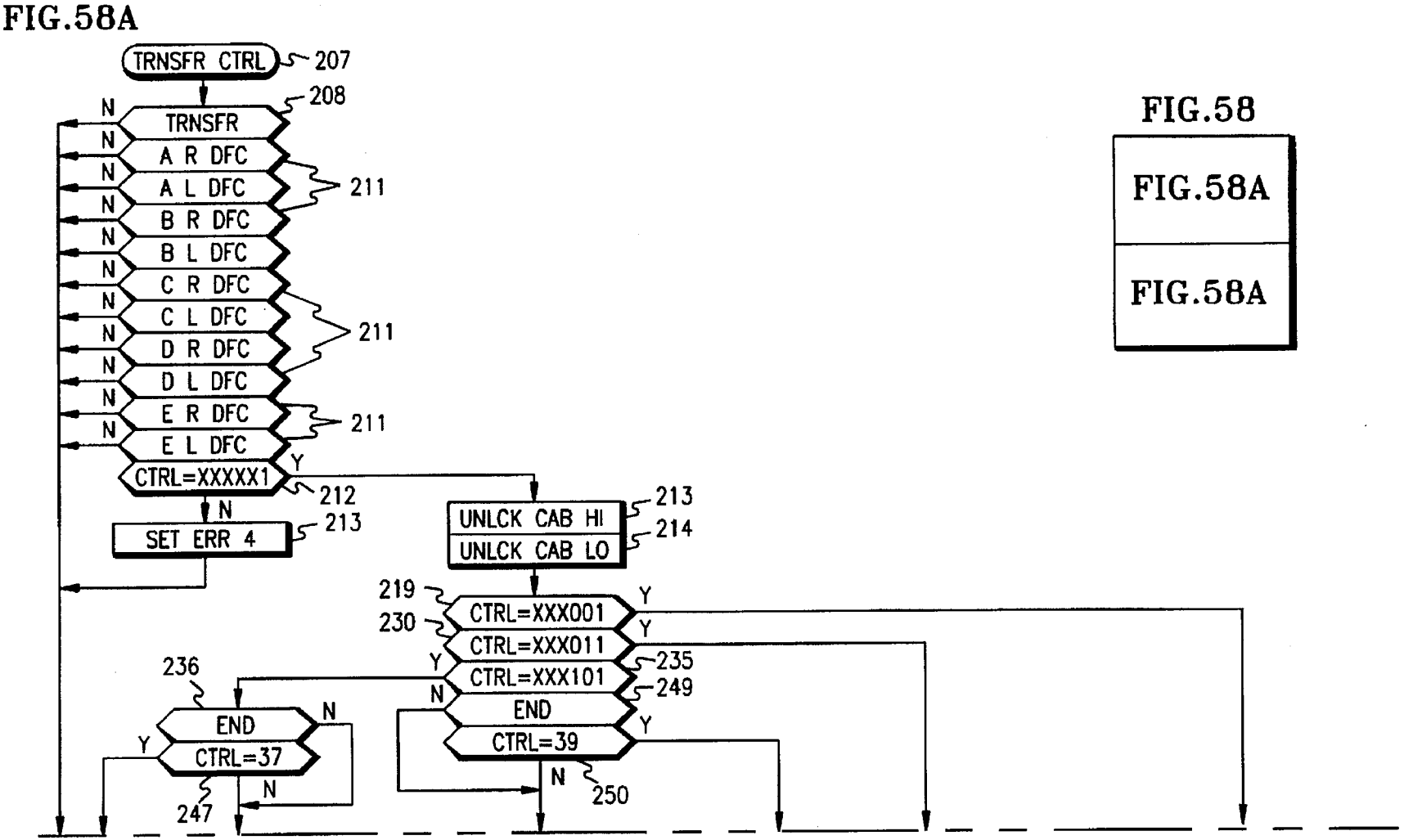
FIG. 58 is a logic flow diagram of a transfer control subroutine for use in the routine of FIG. 53.
Figure 58B:
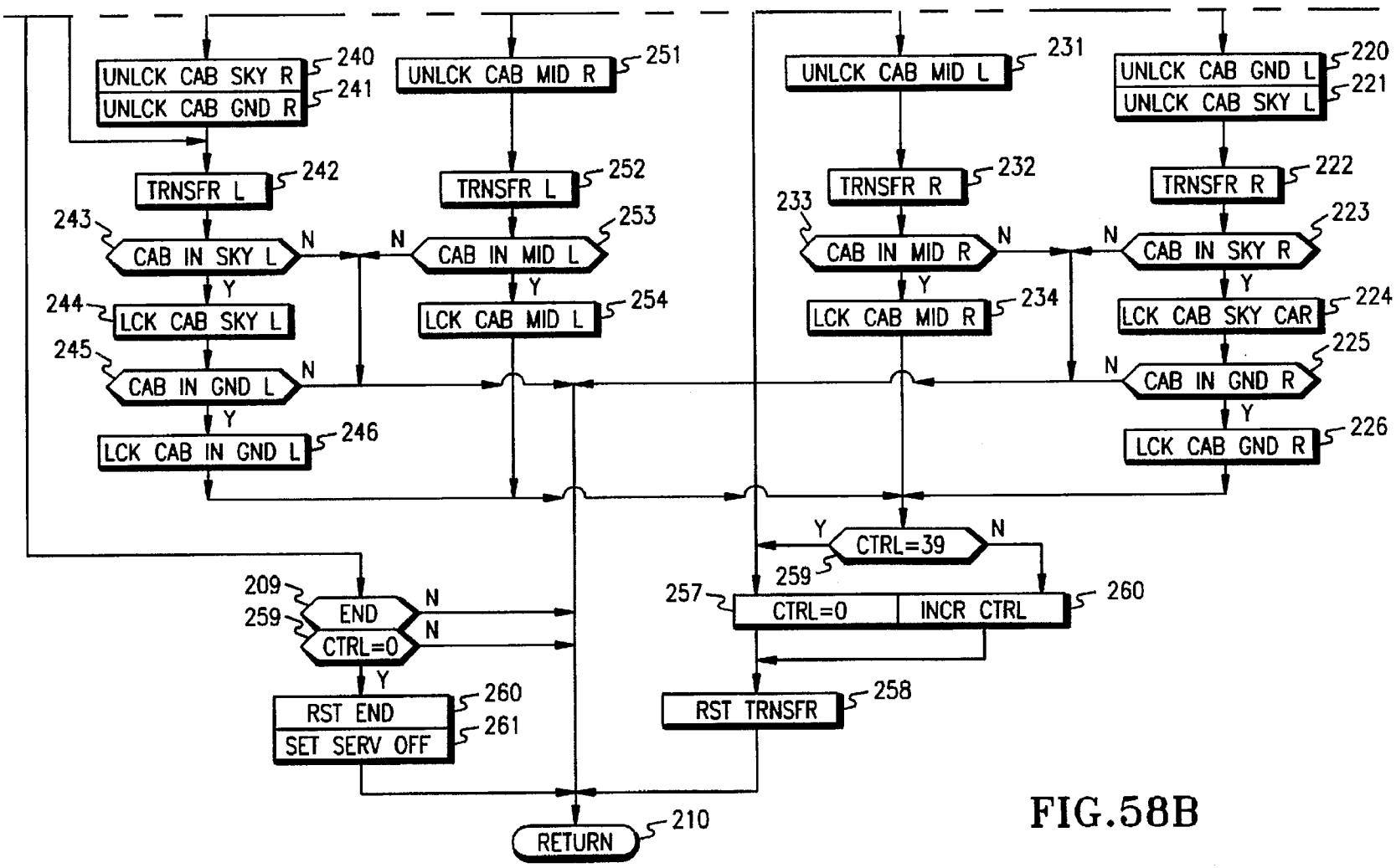

The transfer control subroutine 119, illustrated in FIG. 58, is reached through an entry point 207. A first test 208 determines if the transfer flag has been set in step 168 of FIG. 54. If it has not, then no horizontal movement of any of the cabs is to take place as a consequence of this pass through the subroutine 119. A negative result of test 208 reaches a test 209 to determine if end of normal operations is being established; in normal operation that is not the case, so a negative result of test 209 causes other programming to be reverted to through a return point 210. On the other hand, if the transfer flag has been set, an affirmative result of test 208 reaches a series of tests 211 to determine if both the right and left doors are fully closed on all of the cabs A–E. If any of the doors are open, a negative result of the corresponding test 211 will cause other programming to be reverted to through the return point 210. In the normal case, all of the doors are closed so that affirmative results of all of the tests 211 will reach a test 212 to determine if the control is set odd. Normally it will be, because the control is incremented in step 169 of FIG. 54 from even to odd immediately following the setting of the transfer flag in step 168, except during startup and ending. If the transfer flag is present during an even cycle, it means that something has gone awry and a negative result of test 212 reaches a step 213 to set an error identified here as error four. In a normal case, an affirmative result of test 212 reaches a pair of steps 213, 214 to unlock the cabs that are in both the high and low elevator cars in preparation for horizontal movement out of those cars (see FIG. 41). A test 218 determines if the control is set to a number ending in "001", which represents control numbers corresponding to FIGS. 1, 9, 17, 25 and 33 in which both the high car and the low car have cabs shifting from left to right: that is, the cab on the car is shifted to a right landing and a cab on a left landing is shifted onto the car. If test 219 is affirmative, a pair of steps 220, 221 unlock the cab in both the sky left landing and the ground left landing (these are cabs A and C in FIG. 8, for instance,) and then a step 222 commands a transfer to the right, which is effected in a manner described with respect to FIG. 59, hereinafter. Then a test 223 determines if a cab has been placed completely in the right sky landing (e.g., cab B, FIG. 9). If it has, the cab is locked in that landing by a step 224. While waiting for the cab to be completely in the right sky landing, a negative result of test 223 will cause other programming to be reverted to through the return point 210. Once the cab is locked in the right sky landing, a test 224 determines if a cab is fully positioned in the right ground landing. By this time, it usually will be and an affirmative result of test 224 reaches a step 225 where the cab is locked in the right ground landing (e.g., cab D, FIG. 9) by a step 226.

If test 219 is negative, a test 230 determines if the control number is one which ends in "011". If so, this represents control numbers equal to FIGS. 3, 11, 19, 27 and 35 in which the middle cab is shifted to the right. This causes a series of steps and tests 231–234 which, other than relating to the mid-level, are identical to steps and tests 221–224.

If test 230 is negative, a test 235 determines if the control is set at a number ending in "101". If so, this relates to control numbers equivalent to FIGS. 5, 13, 21, 29 and 37 in which the sky and ground cabs are shifted to the left. An affirmative result of test 235 reaches a test 236 to determine if the end flag is set or not. In the general case, it will not be so a negative result of test 236 reaches a series of steps and tests 240–246 which are respectively equivalent to tests and steps 220–226, except they relate to a transfer to the left. During the ending of normal operations, as is seen in FIG. 43, cabs A and B are shifted to the left, but cabs E and C are left behind. To achieve this, the steps 240 and 241 are bypassed in the event that step 236 is affirmative and a step 247 indicates that the control is set at 37 (represented in FIG. 43). Thus, when transfer takes place, cars C and E remain in the right landings rather than being moved to the left, as described with respect to FIG. 59, hereinafter.

If test 235 is negative, since test 212 indicates that the control is set to an odd number, the only remaining odd number is a control number ending in "111" which is equivalent to control numbers (and therefore Fig. numbers) 7, 15, 23, 31, and 39 in which the cabs at the mid-level are shifted to the left. A negative result of test 235 reaches a pair of tests 249, 250 to determine if the control is set at 39 and the end flag is set. If not, a negative result of either test 249 or 250 will reach a series of steps and tests 251–154 which correspond to the steps and tests 221–224 except that they relate to the cabs at the mid-level being shifted to the left. As can be seen by comparing FIG. 45 with FIG. 39, during control period 39 of an ending operation, no cabs are shifted to the left. Therefore, an affirmative result of both tests 249 and 250 bypass all the steps and tests 251–254 and instead reach a step 257 which sets the control at zero, and a step 258 which resets the transfer flag, because the transfer operation is then complete.

Whenever a transfer operation has been completed at steps 226, 234, 246 or 254, the transfer control subroutine of FIG. 58 reaches a test 259 to see if the control is set at 39 or not. In the usual case, it is not so a negative result of test 259 reaches a step 260 to increment the control to the next higher number. Since the transfer control subroutine 119 runs during the odd cycles, the incrementing of step 260 causes the control to assume an even number. On the other hand, when test 259 is affirmative, then instead of incrementing, the control is reset to zero so as to repeat the functions illustrated in FIGS. 1–40. And, each time test 259 is reached, step 258 will be reached to reset the transfer flag. After that, other programming is reverted to through the return point 210.

In any pass through the transfer control subroutine 119, whenever the transfer flag is not set, or a door is open, or the control is not set to an odd number, negative results of any of the tests 208, 211 or 212 will reach the test 209 to determine if the end flag is set in the process of ending normal operation. If the end flag is set, an affirmative result of test 209 reaches a test 259 to see if the control has reached zero or not. This will only happen in a pass through the subroutine immediately following the pass wherein affirmative results of tests 235 and 249 have caused step 257 to set the control to zero. Affirmative results of both test 209 and 259 reach a step 260 to reset the end flag, and a step 261 to set service off so that subsequent passes through the car cab control routine of FIG. 53 will bypass the subroutines 113–119 due to test 112 being affirmative.

Figure 59:
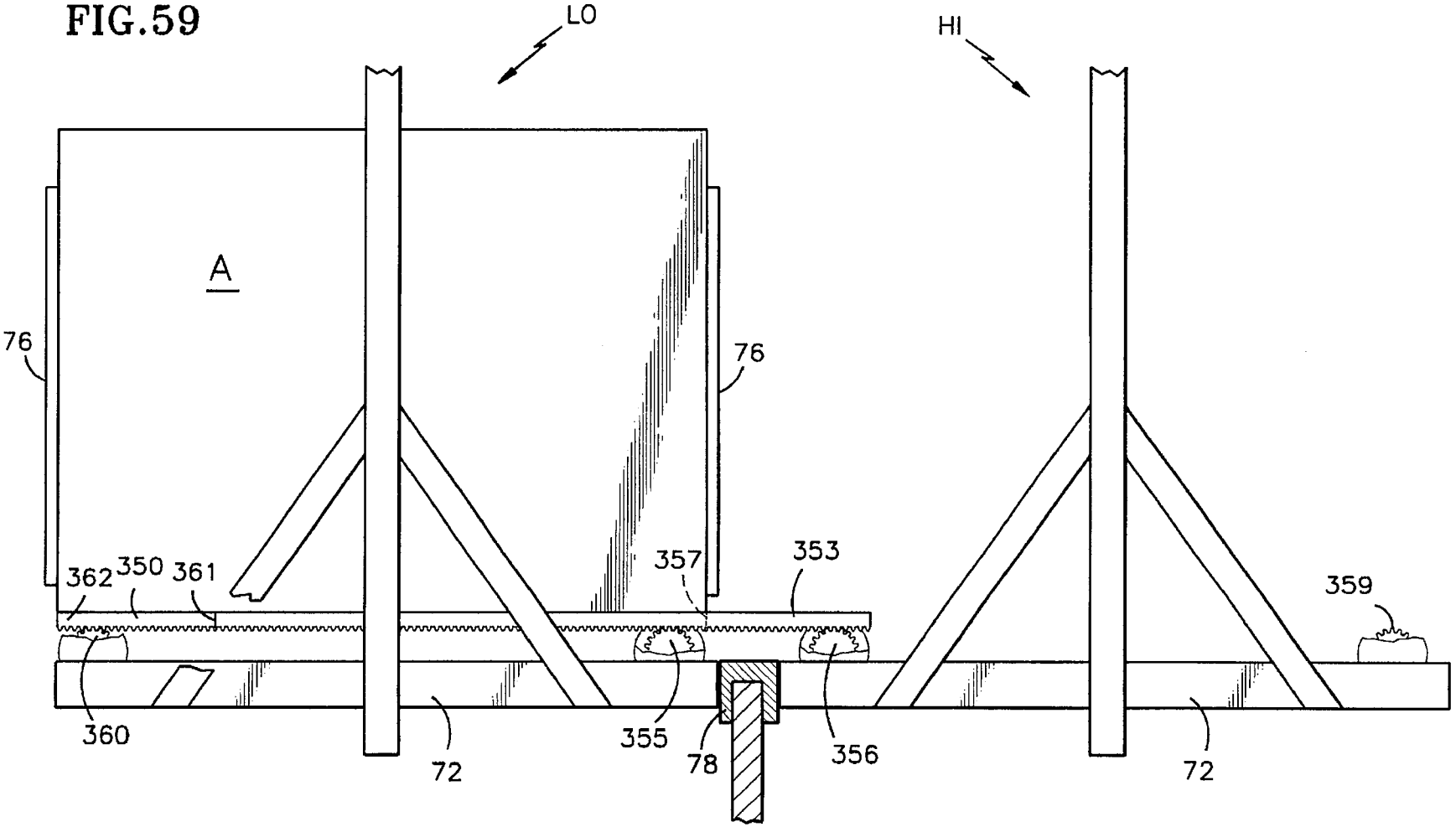
FIG. 59 is a simplified, partially broken away, partially sectioned side elevation view of apparatus for effecting a transfer of elevator cabs, for use in the embodiment of FIG. 41.
Figure 60:
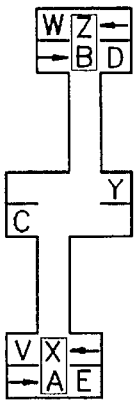
FIGS. 60–65 are simplified illustrations of the synchronized operation of a pair of shuttle elevators according to another embodiment employing double decker elevators.
Figure 61:
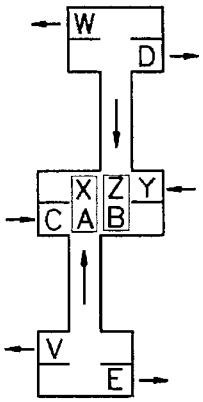
Figure 62:
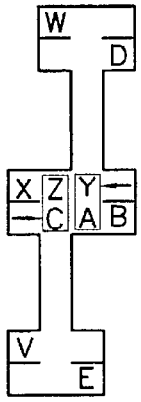
Figure 63:
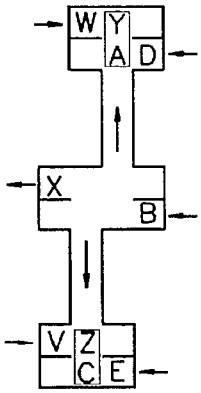
Figure 64:
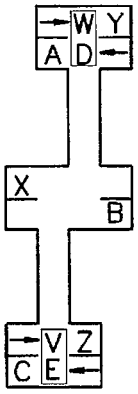
Figure 65:
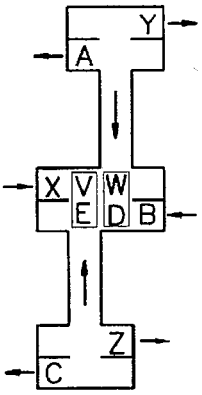

As described with respect to FIG. 41, the cabs are moved simultaneously from landings to car frames, from car frames to car frames, and from car frames to landings. A preferred modality for transferring a cab between cars might be that disclosed in a commonly owned, copending U.S. patent application Ser. No. (Attorney Docket No. OT-2320), filed contemporaneously herewith, as is described briefly with respect to FIG. 59. In FIG. 59, the bottom of the cab A has a fixed, main rack 350 extending from front to back (right to left in FIG. 59), and a sliding auxiliary rack 353 that can slide outwardly to the right, as shown, or to the left. There are a total of four motorized pinions on each of the car frame platforms 72. First, an auxiliary motorized pinion 355 turns clockwise to drive the sliding auxiliary rack 353 out from under the cab into the position shown, where it can engage an auxiliary motorized pinion 356 on the platform 72, which is the limit that the rack 353 can slide. Then, the auxiliary motorized pinion 356 will turn clockwise pulling the auxiliary rack 353 (which now is extended to its limit) and therefore the entire cab A to the right as seen in FIG. 59 until such time as an end 357 of the main rack 350 engages a main motorized pinion (not shown) which is located just behind the auxiliary motorized pinion 356 in FIG. 59. Then, that main motorized pinion will pull the entire cab A fully onto the car frame 72 to the HI elevator by means of the main rack 350, and as it does so, a spring causes the sliding auxiliary rack 353 to retract under the cab A. An auxiliary motorized pinion 359 can assist in moving the cab A to the right to another car frame or landing (if any). Similarly, an auxiliary pinion 360 can assist in moving a cab from a car frame or landing to the left of that shown in FIG. 59 (if any).

To return the cab A from the car frame 72 of the HI elevator to the car frame 72 of the LO elevator, the auxiliary pinion 356 will operate counterclockwise, causing the sliding, auxiliary rack 353 to move outwardly to the left until its left end 361 engages the auxiliary pinion 355. Then the auxiliary pinion 355 pulls the auxiliary rack 353 and the entire cab A to the left until the left end 362 of the main rack engages a main motorized pinion (not shown) located behind the auxiliary motorized pinion 355, which then pulls the entire cab to the left until it is fully on the car frame 72 of the LO elevator.

As described hereinbefore, the invention operated in accordance with FIGS. 1–40 will cause a cab to leave each of the landings once every eight periods of the control, which is once for every four runs of the high and low elevator cars. Since each landing always is the beginning of a trip to a specific destination, a car begins each trip, once for each eight periods of the control (e.g., a passenger may leave the ground level for the sky level in car C in FIG. 8, in car E in FIG. 16, in car D in FIG. 24, and in car B in FIG. 32). A second embodiment of the invention provides that passengers may leave for any destination once for each four periods of the control, by utilizing double decker elevators, the upper and lower decks of which are not moved with the same timing, but rather the cabs in the upper deck are timed four control periods delayed from the movement of corresponding cars in the lower deck. This is illustrated in FIGS. 60–65 wherein cabs V, W, X, Y and Z are deemed to be respectively equivalent to cabs A, B, C, D and E. The figure numbers in parentheses indicate the one of the figure numbers 1–40 which respectively illustrate the condition of one or the other sets of cabs. For instance, in FIG. 60, cabs A–E are in the same position as they are in FIG. 1, but cabs V–Z are in the same position that cabs A–E are in FIG. 37. On the other hand, in FIG. 64, cabs V–Z are now in precisely the same position that cabs A–E are in FIG. 1. In other words, the second sets of cabs V–Z will be doing in any control period, what the first set of cabs A–E had done four control periods sooner. Thus, persons can leave the ground level for the sky level with the door closing during control period 0 (as in FIG. 40) in the lower deck within cab A, and may later leave the ground level for the sky level with the door closing in control period 4 within cab V of the upper deck. Then, persons may leave the ground level for the sky level with the door closing in control period eight within cab C of the lower deck (see FIG. 8) and subsequently may leave the ground level for the sky level with the door closing in control period 12 in cab X in the upper deck, and so forth. In this embodiment, a level may comprise two floors of a building, or may only comprise a single floor with upper and lower landings at different heights on a related floor; or both.

Typical timing for the present invention may include four seconds to transfer a car to the left, four seconds to transfer the car to the right, one-half second per story, so that if the mid-level is at the 80th floor and the sky level is at the 160th floor, the run time from one level to the other for each of the high and low elevators would be on the order of 40 seconds, giving a grand total trip time of 48 seconds to go from one level to an adjacent level. A total trip time from any level to the non-adjacent level requiring three shifts, would be on the order of 92 seconds. The travel time for a single elevator would be twice as long, that is on the order of 160 seconds so that service to which has to be added the time it takes to open the doors, allow passengers to exit and then allow the passenger to enter, which for large elevators may require 12 seconds per landing, pushing the total to over three minutes. (Check out the numbers and move to the front end).

Figure 51:
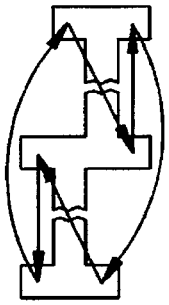
FIG. 51 is a simplified illustration of the operation described in FIGS. 1–40.

As described with respect to FIG. 51 hereinbefore, each car follows a repetitive, unique pattern of travel, and each car follows the same car throughout that path, and is followed by another same car throughout that path, indefinitely. The particular path is a consequence of how the cars are laid out when the system starts up. Referring to FIG. 1, if car C were at the right middle landing instead of the left middle landing, the result would be that the direction of the arrows in FIG. 51 would all reverse. If cabs D and E were also moved from the right sky landing and the right ground landing respectively to the left sky landing and the left ground landing, the result would be that the arrows from the ground to the sky and the sky to the ground would cross: that is, travel would be from the ground left landing to the sky right landing and from the sky left landing to the ground right landing. Similarly, many other alterations can be made in the relative locations of the cars to achieve other patterns. Yet in each case, once the pattern is established, any given landing is dedicated to being the point of entry to reach any particular other given landing, which is invariant, and each car follows the same car around and is followed by the same car around through an invariant, repetitive travel pattern.

The embodiment of the invention thus far is unique in that it provides the same service to all landings: that is, a trip to any particular landing begins on every other round trip cycle of the elevators. That is to say, a trip from the middle level left landing to the ground level left landing begins in FIG. 2, utilizing cab C, and the next trip begins in FIG. 10, utilizing cab E. Similarly, every other trip begins repetitively, once for each two round trips of the elevators. However, a second embodiment of the invention, illustrated briefly in FIGS. 60–65, will provide twice the service, with service leaving any level for any other level once for each round trip of the elevators. This embodiment uses double deck elevator cars and double decker landings at each level, in a manner consistent with the embodiment described thus far with respect to FIGS. 1–59, and well-known double decker elevators. To achieve service that repeats once for each round trip of an elevator, all that is required is that the upper deck system have its particular synchronization with respect to the control periods offset from the control period synchronization of the lower deck system by four control periods. Thus, FIGS. 60–65 show the lower deck system being exactly the same as FIGS. 1–6 hereinbefore. The upper deck system, on the other hand, has the same condition as FIG. 1 hereinbefore in FIG. 64. That is to say, if cabs V, W, X, Y and Z are taken to be respectively corresponding to cabs A, B, C, D and E, then the upper deck system is in the same condition in FIG. 64 as the lower deck system is in FIG. 60. The same control can operate both systems simply by causing the control numbers to be offset by four, as is apparent in FIGS. 60–65.

It is also apparent in FIGS. 60–65 that when the upper deck and lower deck have exactly the same patterns but are offset by four control periods, the transfers are in opposite directions at each level in every instance. However, other combinations of patterns may be utilized, to achieve other characteristics and differing relationships between the upper and lower decks.

The embodiment shown in FIGS. 60–65 has the same dedicated service landings in both decks. That is, service from the ground level to the upper level begins at the left ground landings in both the upper and the lower deck; service from the ground level to the mid-level begins in the ground right landing of both the upper deck and the lower deck; and so forth. This simplifies the collection and guidance of passengers toward the correct landings depending upon their destinations.

Figure 66:
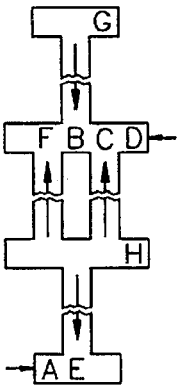
FIG. 66 is a simplified illustration of the synchronized operation of four shuttle elevators according to another embodiment serving four levels.
Figure 67:
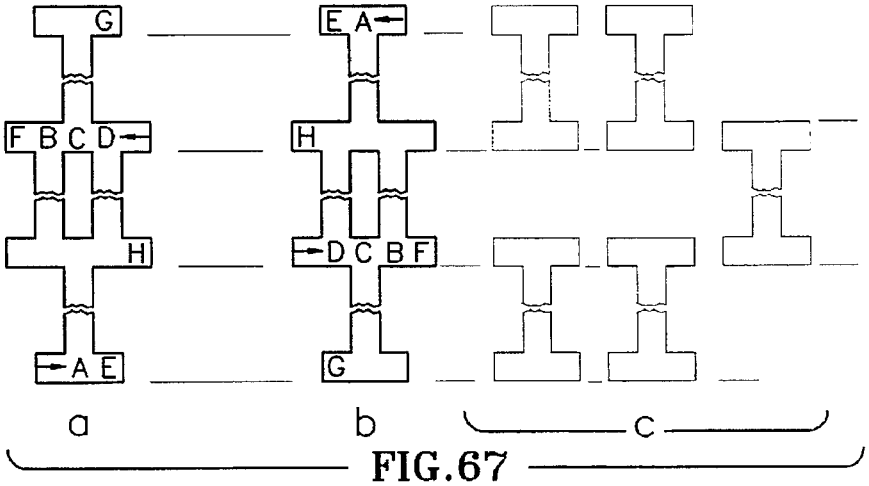
FIG. 67 is a simplified illustrations of the synchronized operation of nine shuttle elevators according to another embodiment with balanced service to four levels.

The embodiments thus far serve three levels. FIGS. 66 and 67 illustrate another embodiment of the invention in which four levels can be served. The pattern illustrated in FIG. 66 advances in the next control period to the pattern illustrated in FIG. 67*a*. This pattern will provide, for each round trip of the elevators: service between the first and fourth level twice; service between the second and third level once; service between the third and first level twice; and service between the fourth and second level twice. In FIG. 67*b* is shown the upside down version of the pattern in FIG. 67*a*. This pattern will provide, for each round trip of its elevators: service between the first and third levels twice; service between the second and fourth levels twice; service between the third and second levels once; and service between the fourth and first levels twice. A combination of the two systems, that shown in FIG. 67*a* as well as that shown in FIG. 67*b*, will provide combined service, for each round trip of all eight elevators as follows: level one to level three, twice; level one to level four, twice; level two to level three, once; level two to level four, twice; level three to level one, once; level four to level one, twice; level four to level two, twice. Therefore, a balanced system which provides two trip starts for any destination for each round trip of its elevators may be achieved by adding to the balanced set shown in illustrations a and b of FIG. 57, the five single level sets shown in illustration c, which will provide an additional single trip in each direction between levels two and three and two additional trips in each direction between levels one and two and levels three and four. Therefore, the system of FIG. 67 provides one trip beginning to any level once for each round trip of the elevators. Of course, the embodiment of FIGS. 56 or 57 could be implemented with time-offset double deckers to provide trip starts for each start-up of an elevator.

The invention may be utilized with other combinations of elevators, numbers of levels and numbers of cabs. In the embodiments herein, the number of cabs equal the summation of the number of levels and the number of elevator cars, since in all of the even numbered control periods (of the embodiment of FIGS. 1–40), there is one cab in each elevator and one cab left behind at each level.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of moving a first elevator cab from a first floor of a building, past a second floor of said building, to a third floor of said building, comprising the steps of:

(a) moving said first elevator cab from said first floor to said second floor along a first elevator hoistway in said building;

(b) at said second floor, moving said first cab to a second hoistway in said building; and (c) moving said first cab along said second hoistway from said second floor to said third floor;

characterized by the improvement in which step (b) comprises:

(d) at said second floor, moving said first cab to said second hoistway simultaneously with moving a second cab from a first landing on said second floor to said first hoistway, and while simultaneously moving a third cab from said second hoistway to a second landing on said second floor on the opposite side of said hoistway from said first landing.

2. A method according to claim 1 further comprising:

(e) before said step (a), moving said cab from a third landing on said first floor to said first hoistway.

3. A method according to claim 2 further comprising:

(f) after said step (c), moving said cab from said second hoistway to a fourth landing on said third floor.

4. A method according to claim 3 wherein said cab is a passenger cab and further comprising:

before said step (a), allowing passengers to transfer from said first floor into said cab within said third landing; and after said step (c), allowing passengers to transfer onto said third floor from said cab on said fourth landing.

5. A method according to claim 1 further comprising:

(g) after said step (c), moving said cab from said second hoistway to another landing on said third floor.

6. A method of moving passengers between two passenger lobby floors of a building, comprising:

providing a plurality of elevators, each having an elevator car movable between two terminal levels in a hoistway, a lower one of said terminal levels of one of said elevators being a lower passenger lobby floor and an upper one of said terminal levels of another of said elevators being an upper passenger lobby floor, the terminal levels of all of said elevators other than said upper and lower passenger lobby floors being at a transfer level of said building along with a terminal level of another one of said elevators, and a plurality of cabs which may be moved horizontally between said landings and said cars;

loading passengers from said lower lobby floor into a cab at a first landing on the corresponding one of said lower terminal levels;

moving said cab from said first landing onto a first one of said cars;

then moving said first car to the other of its terminal levels;

then moving said cab from said first car to another of said cars;

thereafter moving said cab on a second one of said cars to said upper terminal level;

then moving said cab to a second landing at the other of said lobby floors; and then discharging passengers from said cab at said other lobby floor.

7. An elevator system for a building having a plurality of levels, comprising:

a plurality of overlapping elevator hoistways, each having an elevator car frame movable from a low end of the corresponding hoistway to a high end of the corresponding hoistway, each hoistway except the lowest of said hoistways in said system having its low end at the same intermediate building level as the high end of another of said hoistways, each hoistway except the highest of said hoistways in said system having its high end at the same intermediate building level as the low end of another one of said hoistways;

a plurality of elevator cabs; and means for transferring one of said elevator cabs to one of said elevator car frames in one of said hoistways from another of said elevator car frames in another one of said hoistways simultaneously with transferring another of said elevator cabs from said one elevator car frame to a landing at said same intermediate building level of said one and another hoistways.

8. An elevator system according to claim 7 wherein:

said means for transferring transfers said cabs simultaneously with transferring still another of said elevator cabs from another landing at said same intermediate building level to said another one of said elevator car frames.

9. A synchronized elevator shuttle, comprising:

a building having three, mutually-separated levels, with two passenger landings on opposite sides of a hoistway on each level;

a pair or elevators having cars vertically movable in corresponding hoistways, each hoistway extending between two of said levels, each hoistway being adjacent the other at a middle one of said levels to which both hoistways extend;

five elevator cabs, each movable between one of said elevator cars and the other of said elevator cars, each movable between said elevator cars and said landings; and means for, alternatively moving one of said cabs in a first horizontal direction onto a first one of said landings from a first one of said cars, while simultaneously moving another one of said cabs in said first horizontal direction onto said first car from a second one of said cars, and while simultaneously moving another one of said cabs in said first horizontal direction onto said second car from a second one of said landings, or moving one of said cabs in a second horizontal direction onto said first car from said first landing, while simultaneously moving another one of said cabs in said second horizontal direction onto said second car from said first car, and while simultaneously moving another one of said cabs in said second horizontal direction onto said second landing from said second car, or moving one of said cabs in one of said horizontal directions onto a third one of said landings from said first car while simultaneously moving another one of said cabs in said one horizontal direction onto said first car from a fourth one of said landings, and moving one of said cabs in either one of said horizontal directions onto a fifth one of said landings from said second car while simultaneously moving another one of said cabs in said either one direction onto said second car from a sixth one of said landings.

10. A shuttle according to claim 9 wherein:

said cars are double deck cars, each for holding one cab above another cab;

said building includes two upper deck landings and two lower deck landings related to each of said building levels, each upper deck landing above a corresponding lower deck landing;

said shuttle comprises ten cabs; and means for, alternatively moving a first one of said cabs in a first horizontal direction onto a first one of said lower deck landings from the lower deck of a first one of said cars, while simultaneously moving a second one of said cabs in a said first horizontal direction onto the lower deck of said first car from the lower deck of a second one of said cars, while simultaneously moving a third one of said cabs in said first horizontal direction onto the lower deck of said second car from a second one of said lower deck landings, while simultaneously moving a fourth one of said cabs in a second horizontal direction onto the upper deck of said first car from the one of said upper deck landings above said first landing, while simultaneously moving a fifth one of said cabs in said second horizontal direction onto the upper deck of said second car from the upper deck of said first car, and while simultaneously moving a sixth one of said cabs in said second horizontal direction onto the one of said upper deck landings above said second landing from the upper deck of said second car, or moving a first one of said cabs in said second horizontal direction onto the lower deck of said first car from said first lower deck landing, while simultaneously moving a second one of said cabs in said second horizontal direction onto the lower deck of said second car from the lower deck of said first car, while simultaneously moving a third one of said cabs in said second horizontal direction onto said second lower deck landing from said second car, while simultaneously moving a fourth one of said cabs in said first horizontal direction onto said upper deck landing above said first landing from the upper deck of said first car, while simultaneously moving a fifth one of said cabs in said first horizontal direction onto the upper deck of said first car from the upper deck of said second car, and while simultaneously moving a sixth one of said cabs in said first horizontal direction onto the upper deck of said second car from said upper deck landing above said second landing, or moving a first one of said cabs in one of said horizontal directions onto a third one of said lower deck landings from the lower deck of said first car while simultaneously moving a second one of said cabs in said one horizontal direction onto the lower deck of said first car from a fourth one of said lower deck landings, while simultaneously moving a third one of said cabs in another one of said horizontal directions from the one of said upper deck landings above said third landing onto the upper deck of said first car, while simultaneously moving a fourth one of said cabs in said another horizontal direction from the upper deck of said first car onto the one of said upper deck landings above said fourth landing, and moving a fifth one of said cabs in either one of said horizontal directions onto the lower deck of a fifth one of said landings from the lower deck of said second car, while simultaneously moving a sixth one of said cabs in said either one direction onto the lower deck of said second car from the lower deck of a sixth one of said landings, while simultaneously moving a seventh one of said cabs in a direction opposite said either one of said horizontal directions from the one of said upper deck landings above said fifth landing to the upper deck of said second car, while simultaneously moving an eighth one of said cabs in said opposite direction from the upper deck of said second car to the one of said upper deck landings above said sixth landing.

11. A method of operating an elevator shuttle including a plurality of elevators, each having an elevator car frame moveable within a corresponding hoistway between a plurality of levels of a building, each hoistway overlapping at a transfer level of said building with another of said hoistways, and including a plurality of elevator cabs that are moveable onto and off of said car frames, comprising:

(a) loading and unloading passengers to and from elevator cabs that are out of the elevator hoistway at floor landings;

(b) horizontally moving a plurality of cabs in unison to transfer cabs from said landings onto elevator car frames in said hoistways and simultaneously transfer cabs to said landings from said car frames, and, at said transfer level, also simultaneously transfer cabs from one of said car frames to another of said car frames; and (c) moving said car frames in said hoistways between said levels.

12. A method according to claim 11 wherein:

said building includes a pair of floor landings at each level, each on an opposite side of a hoistway from the other.

13. A method according to claim 12 wherein:

each hoistway has only one landing adjacent to it at said transfer level and said step (b) includes transferring a first cab from a first landing at said transfer level to a first car frame in a first hoistway, simultaneously with transferring a second cab from said first car frame to a second car frame in a second hoistway, simultaneously with transferring a third cab from said second car frame to a second landing at said transfer level.

14. A method according to claim 12 wherein said step (b) includes transferring a first cab from a first landing to a first car frame in a first hoistway simultaneously with transferring a second cab from said first car frame to a second landing.

15. A method according to claim 11 wherein said elevator shuttle includes two hoistways overlapping with a third hoistway at a first transfer level and said step (b) includes transferring a first cab from a first landing at said first transfer level to a first car frame in a first one of said hoistways, simultaneously with transferring a second cab from said first frame to a second frame in a second one of said hoistways, simultaneously with transferring a third cab from said second frame to a second landing at said transfer level.

16. A method according to claim 11 wherein said elevator car frames are double deck frames and said landings include upper and lower landings corresponding to the decks of said frames at each level, and said step (b) comprises moving a first cab from a first lower landing to the lower deck of a first frame in a first hoistway simultaneously with moving a second cab from the upper deck of said first frame to an upper landing above said first lower landing.

17. A method according to claim 11 wherein said elevator car frames are double deck frames and said landings include upper and lower landings corresponding to the decks of said frames at each level, and said step (b) comprises moving a first cab from a first lower landing to the lower deck of a first frame in a first hoistway simultaneously with moving a second cab from the upper deck of said first frame to an upper landing above said first lower landing, simultaneously with transferring a third cab to the lower deck of a second frame in a second hoistway from said lower deck of said first frame, simultaneously with transferring a fourth cab to the upper deck of said first frame from the upper deck of said second frame, simultaneously with transferring a fifth cab from a second lower landing to the lower deck of said second frame, simultaneously with transferring a sixth cab to the upper deck of said second frame from an upper landing above said second lower landing.

18. A synchronized elevator shuttle, comprising:

a building having three, mutually-separated levels, with two passenger landings on opposite sides of a hoistway on each level;

a pair or elevators having cars vertically movable in corresponding hoistways, each hoistway extending between two of said levels, each hoistway being adjacent the other at a middle one of said levels to which both hoistways extend;

five elevator cabs, each movable between one of said elevator cars and the other of said elevator cars, each movable between said elevator cars and said landings; and means for moving each of said cabs in turn along a common path, which is the same for all cabs, between levels, between car frames, between landings and car frames, and between car frames and landings, each cab leaving a particular landing always being bound, along said path, to a given corresponding landing, there being a cab leaving each landing periodically in a repetitive cycle.

19. A shuttle according to claim 18 wherein:

said cars are double deck cars, each for holding one cab above another cab;

said building includes two upper deck landings and two lower deck landings related to each building level, each upper deck landing above a corresponding lower deck landing;

said shuttle comprises ten cabs; and said means for moving comprises:

means for moving a first five of said cabs in turn along a first common path, which is the same for all of said first cabs, between levels, between lower decks of car frames, between lower decks of car frames and lower landings, and between lower landings and lower decks of car frames, each first cab leaving a particular lower landing always being bound, along said first path, to a given corresponding lower landing, and for moving a second five of said cabs in turn along a second common path, between levels, between upper decks of car frames and upper landings, and between upper landings and upper decks of car frames, each second cab leaving a particular lower landing being bound, along said second path, to a given corresponding upper landing, there being one of said first cabs leaving each lower landing periodically in a repetitive cycle and one of said second cabs leaving each upper landing periodically in said repetitive cycle.

20. A shuttle according to claim 19 wherein said first cabs leave each lower landing midway between the times at which said second cabs leave the upper landing above each lower landing.

21. A shuttle according to claim 19 wherein each unique particular lower landing is below a particular upper landing on the same level which has a given corresponding upper level above the given corresponding lower level of said unique particular lower landing.

* * * * *